US006483781B2

(12) United States Patent
Igarashi et al.

(10) Patent No.: US 6,483,781 B2
(45) Date of Patent: Nov. 19, 2002

(54) ELECTRONIC WATCH AND DRIVE METHOD THEREFOR

(75) Inventors: Kiyotaka Igarashi, Tokyo (JP); Masao Sakuyama, Tokyo (JP); Akiyoshi Murakami, Tokyo (JP); Kenji Shimoda, Tokyo (JP); Noritoshi Suzuki, Tokyo (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/880,610

(22) Filed: Jun. 13, 2001

(65) Prior Publication Data

US 2001/0043512 A1 Nov. 22, 2001

Related U.S. Application Data

(63) Continuation of application No. PCT/JP00/07136, filed on Oct. 13, 2000.

(30) Foreign Application Priority Data

Oct. 14, 1999 (JP) ..... 11-292411

(51) Int. Cl.[7] ..... G04B 9/00; G04B 1/00; G04C 3/00

(52) U.S. Cl. ..... 368/66; 368/204

(58) Field of Search ..... 368/64, 66, 203–205; 307/116, 119, 125, 126, 130

(56) References Cited

U.S. PATENT DOCUMENTS 5,359,577 A 10/1994 Hoshino et al. ..... 368/67
6,144,621 A * 11/2000 Sase ..... 368/204
6,320,822 B1 * 11/2001 Okeya et al. ..... 368/66

FOREIGN PATENT DOCUMENTS

| | | |
|---|---|---|
| EP | 657 793 | 6/1995 |
| JP | 11-109067 | 4/1999 |
| JP | 11-223682 | 8/1999 |

* cited by examiner

*Primary Examiner*—Vit Miska
(74) *Attorney, Agent, or Firm*—Greer, Burns & Crain, Ltd.

(57) ABSTRACT

A multifunction electronic watch 10 having a large variety of added functions, and providing an electronic watch and drive method therefor that have a high value as a product and a configuration enabling separate use of an energy-saving mode and a function information operating mode, this electronic watch 10 having a reference signal generation means 1, a time information generation means 2, which generates time information TJ based on a reference signal S3R from the reference signal generation means 1, a function information generation means for generating function information FJ, a display drive means 4, which outputs drive signals DRT and DRF for the purpose of displaying the function information FJ and the time information TJ on an appropriate display means, and a display means 5, which displays the function information FJ and the time information TJ based on the drive signals DRT and DRF from the display drive means 4, this electronic watch having an energy-saving operating condition with a power consumption that is less than an normal operating condition, wherein the function operating condition of the function information generation means is given priority over the energy-saving operating condition.

32 Claims, 16 Drawing Sheets

ALARM CONTROL

ELECTRONIC WATCH AND DRIVE METHOD THEREFOR

This is a continuation of International Application No. PCT/JP00/07136 filed Oct. 13, 2000.

FIELD OF THE INVENTION

The present invention relates to an electronic watch and to a method for driving an electronic watch, and more particularly to an electronic watch and drive method therefor, which can improve the value of using an electronic watch having added functions.

BACKGROUND ART

In a known electronic watch of the past, in order to as long a possible a life for a power supply means, formed by a battery or power supply means formed by an electrical generator means combined with a storage cell an energy-saving mode function was added so as to reduce the power consumption of the electronic watch, so long as a problem would not be created with regard to use of the electronic watch.

For example, as indicated in Japanese examined patent application publication H5-60075, in a known electronic watch using a solar cell as the main power supply, in the case in which sunlight does not strike the solar cell for a prescribed length of time, the electronic watch goes into the energy-saving mode, and when sunlight again strikes the solar cell, the energy-saving mode is canceled.

The energy-saving mode function of an electronic watch of the past places first priority on extending the usage life of the power supply as much as possible, and in the case in which there is a condition which is disadvantageous to the power supply, such as when the watch uses the solar cell as a power supply, if the surrounding area becomes dark, the energy-saving mode will be enabled, and drive of a display means, including display of time information is stopped.

In recent years, however, electronic watches having a plurality of built-in function display mechanisms, such as a chronograph display function, an alarm display function, a barometric pressure display function, a water depth display function, and a temperature display function have become practical, and it is possible simultaneously with the display of time or alternating with the display of time to display one or a plurality of such function information on a prescribed display means.

In these recent electronic watches, if the energy-saving mode used in the past is utilized, in the case in which in a situation disadvantageous to the power supply occurs, because it becomes impossible to display not only the time information, but also function information on the display means, in particular in an environment in which the function information is required, the function information display means cannot be used, thereby sacrificing the product value of a multifunction electronic watch.

Accordingly, it is an object of the present invention to improve. on the above-noted drawbacks in the past technology, by providing, an electronic watch in a multifunction electronic watch capable of providing a large number of types of added function information, an electronic watch and drive method therefor providing an individually usable energy-saving mode and function information operation state mode.

DISCLOSURE OF THE INVENTION

In order to achieve the above-noted object, the present invention has the following technical constitution.

Specifically, a first aspect of the present invention is a an electronic watch having a reference signal generation means, a time information generation means for generating time information based on a reference signal from the reference signal generation means, a function information generation means for generating function information, a display drive means, which outputs a drive signal for displaying function information and time information, and a display means for displaying function information and time information based on a drive signal from the display drive means, this electronic watch having an energy-saving operating condition-in which the power consumption is less than in a normal operating condition, and being configured so that a function operating condition of the function information generation means is given higher priority than the energy-saving operating condition.

A more specific example of the present invention is a second aspect of the present invention, this being an electronic watch having a reference signal generation means, a time information generation means for generating time information based on a reference signal from the reference signal generation means, a function information generation means for generating function information, a display drive means, which outputs a drive signal for displaying function information and time information, and a display means for displaying function information and time information based on a drive signal from the display drive means, this electronic watch having an energy-saving operating condition in which the power consumption is less than in a normal operating condition, and being configured so that when the function information generation means operates during the energy-saving operating condition, the energy-saving operating condition is cancelled.

Additionally, a third aspect of the present invention is a more specific example of the above-noted first aspect thereof, this being an electronic watch a reference signal generation means, a time information generation means for generating time information based on a reference signal from the reference signal generation means, a function information generation means for generating function information, a display drive means, which outputs a drive signal for displaying function information and time information, and a display means for displaying function information and time information based on a drive signal from the display drive means, this electronic watch having an energy-saving operating condition in which the power consumption is less than in a normal operating condition, and being configured so that if a condition for entering the energy-saving operating condition is satisfied while the function information generation means is in an operating condition, the watch does not enter the energy-saving operating condition.

DESCRIPTION OF THE PREFERRED EMBODIMENTS

Figure 1:
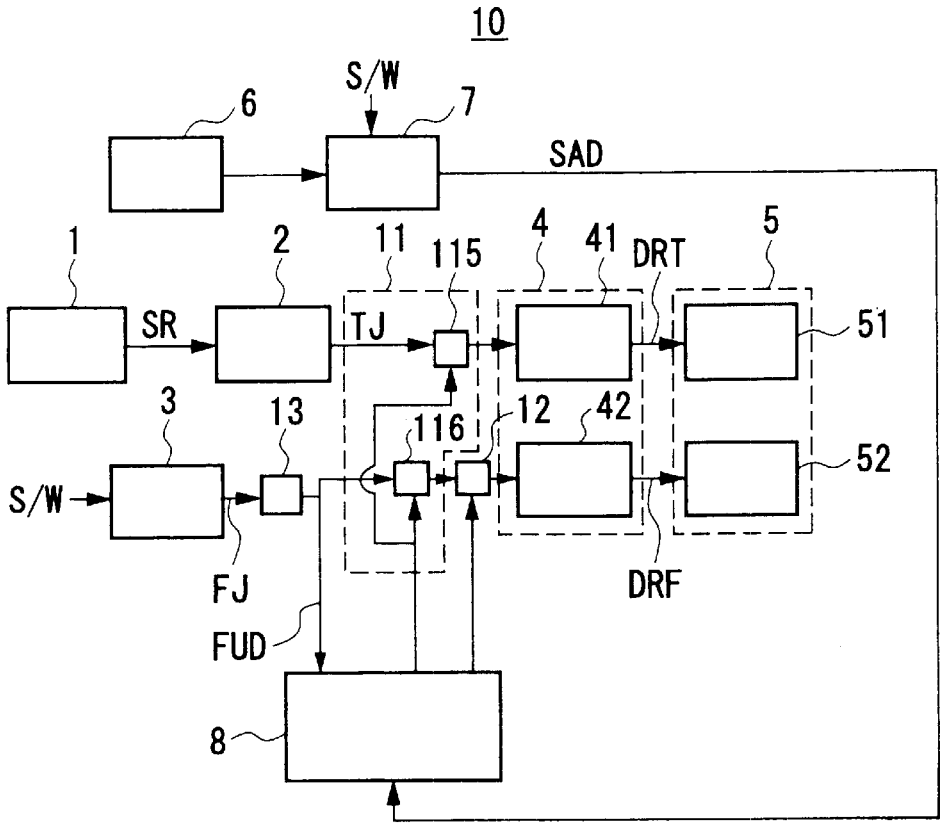
FIG. 1 is block diagram showing a configuration of an example of an electronic watch according to the present invention.

By adopting the above-noted technical constitution, in an electronic watch according to the present invention in the case in which there is contention between the energy-saving operating condition and the function operating condition in the display means, the relative priority between the energy-saving operating condition and the function operating condition is pre-established, and the mode is selected as either the energy-saving operating condition or the function operating condition, in accordance with this priority sequence. More specifically, the present invention is configured so that the function operating condition is given priority over the energy-saving operating condition, so that if contention arises between the energy-saving operating condition and the function operating condition, the function operating condition will be selected, the energy-saving operating condition being cancelled.

As a result, the user of the electronic watch, even in an environment in which it is possible to drive the energy-saving operating condition, is able for example to obtain function information in accordance with added functions as necessary, so that in the case of a darkened room, for example, it is possible to cause operation of an alarm function.

That is, basically in the present invention, although it is possible to extend the life of a battery as much as possible by causing drive of the electronic watch in the energy-saving operating condition, in view of the need to enhance the value of the electronic watch as a product, in the case in which it is necessary to use various added functions, priority is given to the function display operating condition over the energy-saving operating condition, so that when in the energy-saving operating condition if it is desired to cause execution function display operation, the energy-saving mode is cancelled, and when a signal for entering the energy-saving mode is generated when a function display operating condition is being executed, this signal is ignored.

A specific example of an environment in which is necessary to have either the energy-saving operating condition or the function operating condition is one in which there is a display means for hour, minute, and second hands or a liquid-crystal display or the like, and various display means circuit parts for all or part of related circuits controlling these. The present invention need not be applied to all of these display means, and can be applied to a display means related to a function operating condition, in which case a display means not related to a function operating condition configured so as to go into the energy-saving mode regardless of the function operating condition, for example, when the amount of electricity generated by an electrical generation means decreases. Additionally, of course, the configuration can be, such that in the case in which the amount of electricity generated by the electrical generation means does not decrease, the normal operating condition can be enabled.

Specific examples of an electronic watch and a drive method for an electronic watch according to the present invention are described in detail below, with references mad to drawings.

In the descriptions that follow, although a display means (display of hour, minute, and second hands, a function hand, or a liquid-crystal display or the like) is used to implement the energy-saving operating condition or function operating condition, this display means is no more than an example in the present invention, and it will be understood that also included within the scope of the present invention would be a circuit part having either direct or indirect relationship to a display means, which can implement an energy-saving operating condition or a function operating condition.

Specifically, FIG. 1 is a partially expanded drawing illustrating the configuration of an electronic watch 10, which is an example of the present invention. This drawing shows the electronic watch 10, which has a reference signal generation means 1, a time information generation means 2, which generates timing information TJ based on a reference signal SR from the reference signal generation means 1, a function information generation means 3, which generates function information FJ, a display drive means 4, which outputs drive signals DRF and DRT for displaying the function information FJ and the time information TJ on an appropriate display means, and a display means 5, which displays the function information FJ and the time information TJ, based on the drive signals DRF and DRT from the display drive means 4, this electronic watch 10 having an energy-saving operating condition in which the power consumption is less than in a normal operating condition, and having a configuration in which the function operating condition of the function information generation means 3 is given priority over the energy-saving operating condition.

More specifically, as shown in the block diagram of the electronic watch 10 according to the present invention presented in FIG. 1, the electronic watch 10 has a control means 8, an energy-saving operating condition setting means 11, which, in response to a detection signal SAD from an energy-saving operating condition detection means 7, sets at least part of a display means, for example at least one part of a time information display means 51 or at least one part of a function information display means 52 or both of these to the energy-saving operating condition, and a function operating condition setting means 12, which, in response to a function operating condition setting detection signal FUD of a function operating condition detection means 13, sets at least one part of the function information display means 52 to the function operating condition. In the case in which there is contention between the energy-saving operating condition detection signal SAD and the function operating condition detection FUD, the control means 8 performs control so as to give priority to the function operating condition of the function information display means 52 over the energy-saving operating condition in the time information display means 51.

In this example, there are cases in which the time information display means 51 and the function information display means 52 are configured as separate circuits, and cases in which part or all of their circuitry overlap.

Additionally, the reference numeral 115 in the drawing is a energy-saving operating condition setting means for the time information display means, and 116 is an energy-saving operating condition setting means for the function information display means.

For example, a second hand 23 in the time information display means for the time information display means 51 for the normal operating condition, in the case of providing a chronograph display by the function information display means, this is used as a means to display the chronograph seconds.

In another example of the present invention, in the electronic watch 10 having the configuration shown in the above-noted FIG. 1, it is possible to configure the control system such that, in the case in which the function information generation means 3 goes into the operating condition during the energy-saving operating condition, the energy-saving operating condition is cancelled. In yet another specific example, in the electronic watch 10 having the configuration shown in the above-noted FIG. 1, it is also possible to configure the control system such that, even if a condition for going into the energy-saving operating condition is satisfied during the operating condition of the function information generation means, neither of the display means 51 nor 52 goes into the energy-saving operating condition.

More specifically with regard to the configuration of an electronic watch and electronic watch drive method according to the present invention, it is desirable that the control means 8 in the electronic watch 10 be configured so that in the case in which the display means 5 and particularly the time information display means 51 is in the normal operating condition of displaying the time information, the time information display means 51 is placed into the energy-saving operating condition or the function information display means 52 is placed into the function operating condition, in response to the output signal FUD of the function operation condition detection means 13 or the output signal SAD of the. energy-saving operating condition detection means 7, and so that in the case in which the output signal SAD is input from the energy-saving operating condition detection means 7 when the function information display means 52 is in the function operating condition, the output signal SAD from the energy-saving operating condition detection means 7 is invalidated.

Additionally, it preferable that the control means 8 be configured such that, in the case in which, in response to the output signal FUD of the function operating condition detection means 13 or the output signal SAD of the energy-saving operating condition detection means 7, the time information display means 51 and/or the function. information display means 52 is placed into the energy-saving operating condition or only the function information display means 52 is placed into the function operating condition, both display means 5 being placed in the energy-saving operating condition, if the output signal FUD is input from the function operating condition detection means 13, the energy-saving operating condition of both or one of the display means 5 is cancelled, and the function information display means 52 is set to the function operating condition.

In an electronic watch 10 according to the present invention, at least one of the time information display means 51 and the function information display means 52 can be implemented as a digital display mechanism or an analog display mechanism, and it is desirable that the other circuit configuration be implemented accordingly, using either analog circuit configuration or a digital circuit configuration.

The display means 5 in the present invention can be formed by a separate time information display means 51 and function information display means 52, or can be formed with part or all of the circuitry of these two elements overlapping.

For example, in the case in which the electronic watch 10 makes use of an analog display system, the second hand can be used to indicate both information.

The power supply means in. an electronic watch 10 according to the present invention is not restricted to any particular configuration, and can be a normal button-type primary cell, or a rechargeable secondary cell. It is additionally possible to use an electrical generation means such as a solar cell, a self-winding electrical generator, or a temperature-difference electrical generator or the like.

In a further preferable example of the present invention, the power, supply means is in the form of a combination of an electrical generation means and a storage cell.

The display means 5 used in the electronic watch 10 according to the present invention can be formed by a separate time information display means 51 and function information display means 52, and can also be the same element.

For example, the hour, minute, and second hands in the time information display means 51 can be used for part or all of the function information display means 52.

The energy-saving operating condition detection means 7 used in the present invention makes a judgment with regard to the current condition of the power supply means 6, formed by a battery or an electrical generating means, and outputs information used as the basic for a judgment as to whether or not to set the energy-saving operating condition, which greatly reduces the power consumption of the display means 5 compared with the normal operation thereof, this being the energy-saving operating condition detection signal SAD, and in the case in which, for example, the residual battery capacity of the battery in the power supply means falls below a prescribed threshold value, the case in which the output voltage or output current of the battery falls below a prescribed threshold value, and the case in which the amount of electricity generated by the electrical generating means falls below a prescribed threshold value, and in the case of a solar cell power supply means, if the amount of incident sunlight falling over a prescribed continuous time is below a prescribed value, for example, these condition can be automatically detected, and the energy-saving operating condition detection signal SAD is output, and additionally the user of the electronic watch 10 can manually press a prescribed button so the stem or the like, this operation being detected, so that the energy-saving operating condition detection signal SAD is output.

For example, in the case in which the user of the electronic watch 10 has a number of electronic watches, it can be envisioned that, if one of them is to be left unused for quite a long time, a manual operation can be performed on the electronic watch 10 so as to set the energy-saving operating condition therein.

Even in the case in which at least part of the display drive means 4 and at least part of the display means 5 of the electronic watch 10 according to the present invention have gone into the energy-saving operating condition, although display information from at least part of the display means 5 becomes faint or is disappears, or the operation of the display means stops, the time information in the electronic watch 10 is normally kept, and this state is stored in a prescribed storage means, so that in the case in which the energy-saving operating condition is cancelled, the time information can be immediately displayed on the time information display means 51, for example.

In the electronic watch 10, the condition required in order to be able to cancel the energy-saving operating condition when the above-noted energy-saving operating condition is set is that the condition that is the opposite of the above-noted detection signal generation must be detected.

In addition, the function information used in the electronic watch 10 according to the present invention is information for at least one added function, such as an alarm function, a chronograph function, a calendar display function, a water depth display function, a barometric pressure display function, an altitude information display function, an air temperature information display function, and a water temperature information display function.

In the present invention, in the case in which the user of the electronic watch 10 wishes to use the above-noted added functions, the user operates a prescribed button or stem, which serves as function information generation means corresponding to one of the group of added functions, so as to select a prescribed function, whereupon a function operating condition detection output signal FUD is output from the function operating condition detection means 13.

In the case in which the function information of the function information generation means 3 of the present invention water depth function information, the condition for canceling from the energy-saving operating condition is that it is possible to use the detection of the on condition of the water-sensing switch.

In the present invention, a prescribed means that is stopped when the energy-saving operating condition is enabled is, for example, a prescribed means that operates when an appropriate display means 51 and the function information generation means 3 go into the function operating condition, for example, it is also possible, for example, for an appropriate display means 52 to be configured with partial overlap, so that, and the second hand noted above corresponds to this.

In the present invention, the energy-saving operating condition is configured so as to stop a part of the time information display of the time display means 51.

In the present invention, when the function information generation means goes into the function operating condition, all prescribed display means that are stopped when the energy-saving operating condition is entered are configured so that the energy-saving operating condition of the display means that is in the energy-saving operating condition is cancelled.

In the present invention even if a part of prescribed means that stop when the energy-saving operating condition occurs goes into the function operating condition of the function information generation means, the configuration is such that the energy-saving operating condition is maintained.

That is, part of the display means is formed in a condition that is absolute unrelated to the function operating condition, so that regardless of when or not there is a function operating condition, only by a direct output from the energy-saving operating condition detection output means will either the energy-saving operating condition or the normal operating condition be taken, for example, in the case of a calendar information display means or the like.

An further detailed example of an electronic watch and a drive method for an electronic watch according to the present invention is described below, with references made to FIG. 2 through FIG. 9.

Figure 2:
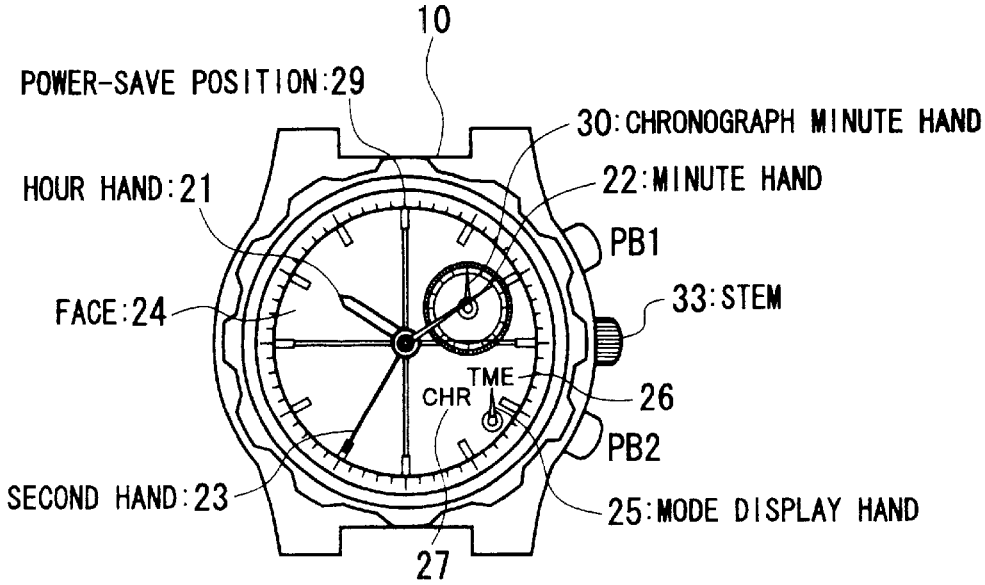
FIG. 2 is a front view showing an example of the configuration of the outer appearance of a first example of an electronic watch according to the present invention.

Specifically, the present invention is an electronic watch 10 having a configuration as shown in FIG. 2, this having a face 24, hour and minute hands 21 and 22, and a second hand 23 for normal time information display.

In this example, the above-noted second hand 23 also serves as a second hand for a chronograph display.

Additionally, in the present invention a mode display hand 25 is provided, the position of this mode display hand 25 setting individually different functions.

In this example, the mode display hand 25 is configured so as to be able to adopt a time information display position (TME) 26 in which case the normal time information is displayed, and a chronograph display position (CNR) 27 in which case a chronograph display function is executed, and the mode display hand 25 can be moved to a prescribed position by operating the stem 33.

That is, in the present invention when the mode display hand 25 is set to the time information display position (TME) 26, either automatically at the point at which a condition required for going into the above-noted energy-saving operating condition is detected, or manually in response to a user pressing a prescribed button PB1 or PB2, the second hand 23 moves to the 0 second position, which is the power-saving position 29, thereby indicating that the electronic watch 10 is set to the energy-saving operating condition.

In order to cancel the energy-saving operating condition and the like, a specific button PB1 or PB2 provided in the electronic watch is pushed in, and the energy-saving operating condition can also be cancelled automatically by a prescribed detection signal.

On the other hand, if the mode display hand 25 is set to the chronograph display position (CNR) 27, the chronograph display function starts from this point, the second hand indicating the chronograph seconds, and operating together with the chronograph minute hand 30 to keep chronograph time.

The detailed circuit configuration of an electronic watch 10 according to the example shown in FIG. 2 is described below, with references being made to FIG. 3 through FIG. 5.

Figure 3:
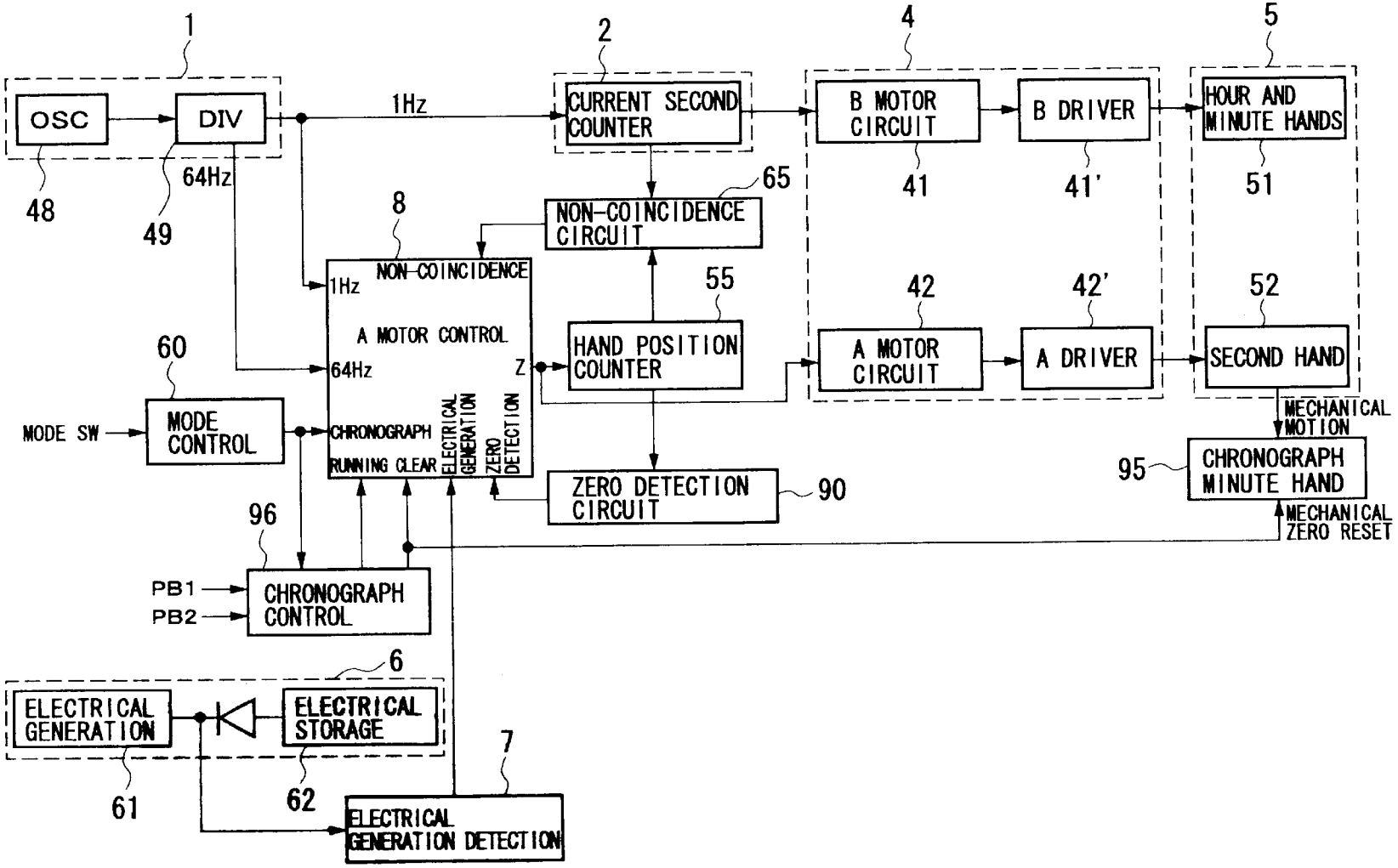
FIG. 3 is a block diagram showing the configuration in the first example of an electronic watch according to the present invention.

That is, FIG. 3 is a block diagram showing an example of the electronic watch 10 driven and controlled as an analog watch, with chronograph function as an added function thereto, the time information display means 5 being configured by a time information display means 51, represented by the hour and minute hands 21 and 22, and the time information display means 52, represented by the second hand 23, this second hand 23 also serving as a function information display means 52, which displays the chronograph function.

Additionally, a display drive means 95 is provided, which drives the chronograph minutes hand 30.

As is clear from FIG. 3, in this example as well, there is a reference signal generation means 1, formed by an oscillator circuit 48 and a frequency division circuit 49, and a time information generation means 2, which includes, for example, an appropriate current second counter means, which inputs a 1-Hz reference signal SR output from the frequency division circuit 49 and generates time information TJ, a control means, which includes a chronograph function display control circuit 82, to be described below, which generates the function information FJ as chronograph function information or the like, a display drive means 4, which includes motor circuits 41 and 42, which output drive signals DRT and DRF for displaying the function information FJ and the time information TJ on an appropriate display means 5, and driver circuits 41' and 42', which drive the display means 51 and 52, a display means 5, which is formed by a time information display means 51, which, based on the drive signals DRT and DRF from the display drive circuit 4, displays the function information FJ and the time information TJ, and a display means 52 which serves as both a time information display means and a function information display means, and a control means 8, which includes a function operation priority means 83, to be described below, which inputs the mode selection information signal, the energy-saving operating condition detection signal, and the function operating condition detection signal, and which, according to a prescribed algorithm, controls the circuit so as to give priority to function information display condition over the energy-saving operating display condition.

Additionally, the control means 8 is configured so as to have a mode control circuit 60 for the purpose of moving the mode display hand 25 to a prescribed position when the stem 33 is operated, a chronograph display function control means 96 operating in accordance with a signal from the mode control circuit 60, and an energy-saving operating condition detection means 7, which detects the output voltage or the output current from the power supply means 6, which is formed by the electrical generation means 61 and the storage cell 62, and makes a judgment as to whether or not the power supply means 6 requires an energy-saving operating condition in the display means, wherein in the case in which the energy-saving operating condition is being executed a zero detection circuit 90 moves the second hand 23 to the zero hour position, which is the power-saving position, a signal being input from a non-coincidence detection circuit 65, which detects non-coincidence between the current counter value of the hand position counter 55, which verifies the position of the second hand 23, and the current value of the second hand position counter of the time information display means 2.

Additionally, the control means 8 in this example has input to it from the reference signal generation means 1 a 1-Hz signal used to drive the hour, minute, and second hands in the normal operating condition, and a 64-Hz signal used for fast forward of the hour, minute, and second hands, and further as required has input to it a mode selection information signal output from the mode control circuit 60, an energy-saving operating condition detection signal output from the energy-saving operating condition detection means 7, a signal regarding the usage condition of an added function, for example, when a chronograph is being used, information for a RUN and a CR signal of the chronograph function, and the output from the zero detection circuit 90.

Figure 4:
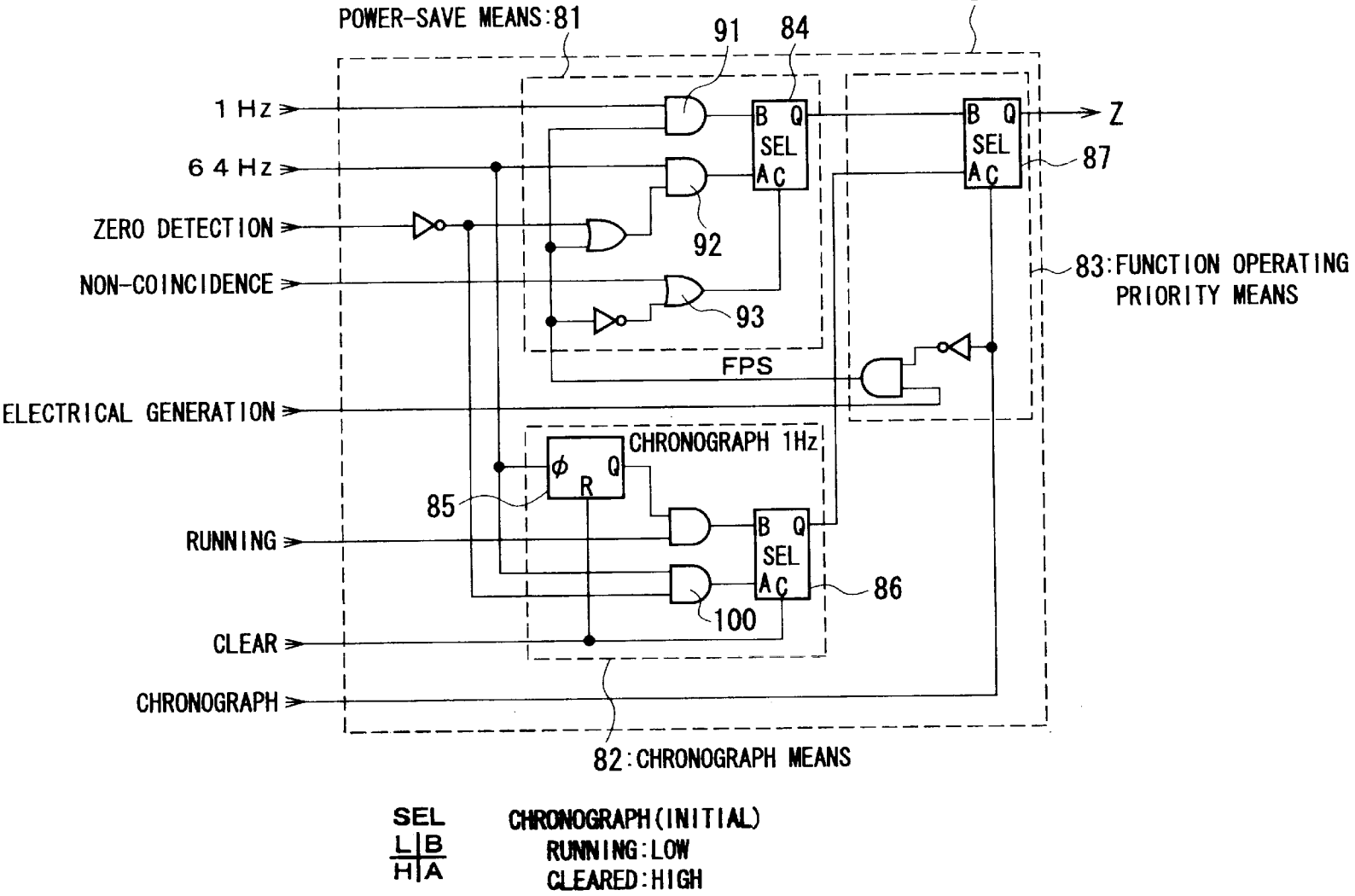
FIG. 4 is a circuit diagram showing an example of the configuration of a control means in the first example of an electronic watch according to the present invention.

The configuration of the control means 8 used in this example is shown in the block diagram of FIG. 4.

The block diagram of FIG. 4 shows a control circuit within the control means 8 for the purpose of controlling the display drive means 42 which drives the display means 52, corresponding to the second hand 23, and the associated A driver means 42', a control circuit for controlling drive of the display means 51, corresponding to the hour and minute hands 21 and 22, of course having the same configuration.

That is, as shown in FIG. 4, the control means 8 is made up of a power-saving control circuit 81 and, for example, a chronograph function display control circuit 82 and function operation priority control circuit 83, the power-saving control circuit 81 having input to it 1-Hz and 64-Hz pulse signals, the outputs of the zero detection circuit 90 and the non-coincidence circuit 65, and the function operation priority control signal FPS output from the function operation priority control circuit 83 and the like, the chronograph function display control circuit 82 has input to it the 64-Hz pulse signal, the output signal of the zero detection circuit 90, and the running signal and clear signal of the chronograph display function, and the function operation priority control circuit 83 has input to it a function operation condition output signal, which indicates the operating condition of the chronograph display, the output signal from the power-saving control circuit 81, and the output signal from the chronograph function display control circuit 82 and the like.

In the control circuit 8, first in the case of the normal operating condition a selector 84 in the power-saving control circuit 84 is configured so as to output the signal input to the B input terminal thereof, because the added function does not operate in the function operation priority control circuit 83 as well, the configuration is such that the selector 87 in the function operation priority control circuit 83 also outputs the signal input to the B input thereof, so that the 1-Hz pulse signal drives the display drive means 42, which drives the second hand 23, the result being that the second hand 23 indicates the time information at all times.

In this condition, because the function operation priority control signal FPS is at the high level, the AND circuit 91 applies the input 1-Hz pulse signal through as is to the selector 84.

The configuration can be such that the same type of operation is performed with regard to the hour and minute hands 21 and 22, and, as noted above, with regard to the hour and minute hands 21 and 22 the configuration is such that drive of these hands does not stop, even if the energy-saving operating condition is detected.

Additionally, in this example in the case in which the energy-saving operating condition is detected, because the energy-saving operating condition detection signal SAD changes to low level, the function operation priority control signal FPS output from the function operation priority control circuit 83 also changes to the low level, so that the AND circuit 91 blocks the 1-Hz pulse signal input thereto.

Simultaneously, because the output of the zero detection circuit 90 changes to the low level, the 64-Hz pulse signal from the AND circuit 92 is output, and is input to the A terminal of the selector 84.

When the second, hand 23 position reaches the 0 second position, the output of the zero detection circuit 900 changes to the high level, and the second hand 23 stops.

Next, in the present invention in the case in which the energy-saving operating condition is cancelled, because the energy-saving operating condition detection signal SAD output from the energy-saving operating condition detection circuit 7 changes to the high level, the function operation priority control signal FPS output from the function operation priority control circuit 83 also changes to the high level.

Simultaneously, because there is non-coincidence between the position of the second hand 23 and the contents of the hand position counter 55, a high-level signal is input to the non-coincidence terminal of the control circuit 8, so that a high-level signal is output from the OR circuit 93, so that the selector 84 outputs the input at the A terminal thereof to the output Q terminal, thereby resulting in the 64-Hz pulse signal being output from the B input terminal of the selector 87 in the function operation priority control circuit 83 to the output Q, this resulting in the second hand 23 being fast forwarded so as to move to the current second position, the energy-saving operating condition being thus cancelled.

The selectors 84 and 85, and the selector 86 to be described below, of the control means 8 are configured with logic such that, in the case in which the control signal input to the control terminal C is at the low level, the signal input to the B input terminal is output at the output Q, and in the case in which the control signal input to the control terminal C is at the high level, the signal input to the A input terminal is output to the output Q.

In the case in which, for example, with the electronic watch 10 is displaying the time in the normal operating condition, the energy-saving operating condition detection signal SAD from the energy-saving operating condition detection means 7 is input to the control means 8, the 64-Hz pulse signal is used for fast forward until the contents of the hand position counter 55 reach the 0 second position, and the second hand 23 and 64-Hz pulse signal are also used to execute a fast-forward operation, so that the second hand 23 is moved to and stopped at the 0 second position.

As a result, the display drive means of either one of or both of the time information display means and the function information display means can be stopped, so that either one or both of the time information display means and function information display means is stopped, and it is also possible to stop only the second hand 23, with the hour and minute hands 21 and 22 in the normal display operation condition, in which they move.

In the above-noted condition, if an instance occurs in which the user wishes to use the chronograph function, the user first operates the stem 33 in the example of the mode control circuit 60, so that the mode display hand 25 is moved to the chronograph function position CNR 27.

The second hand 23 remained stopped at the 0 second position.

Figure 5:
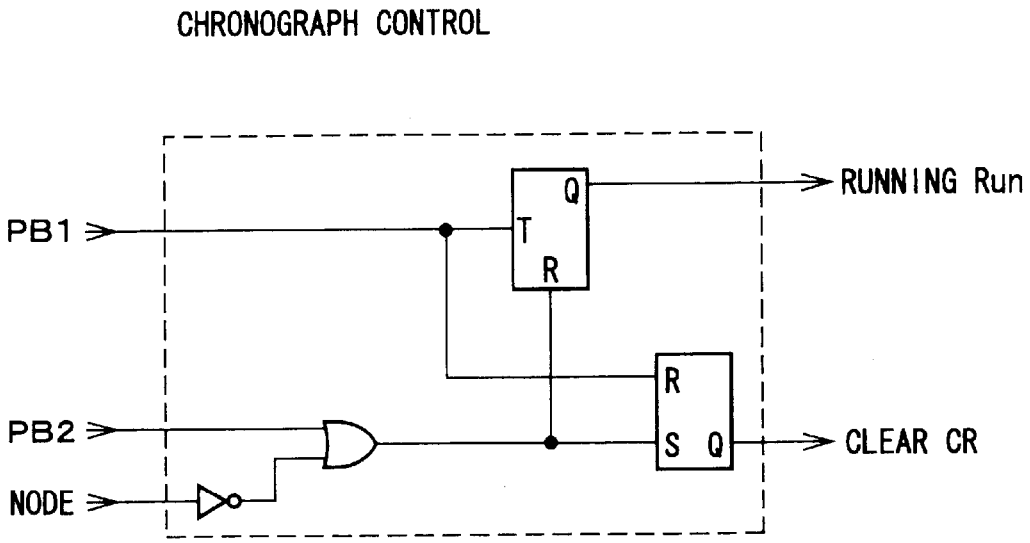
FIG. 5 is a circuit diagram showing an example of the configuration of a chronograph control circuit in the first example of the electronic watch.

In the example of the chronograph display function control means 96, as shown in FIG. 5, the output signals from the buttons PB1 and PB2 and the selection signal in accordance with the mode selection means 33 are input, and a RUN signal, indicating the chronograph display function is currently running, and a CR signal, indicating that the chronograph display function is in the cleared condition, are output, the RUN signal indicating the chronograph display function is running and the CR signal indicating that the chronograph display function is in the cleared condition being input, respectively, to the Running and the Cleared terminals of the control circuit 8.

First, in the above-noted control circuit 8, in terms of the case in which the chronograph function is used in the normal operating condition, when the chronograph display is specified, the second hand 23 of the electronic watch 10 is returned to the 0 second position, and an operation is performed so as to synchronize the start of the second hand, with the start of the chronograph minute hand 30.

First, in order to return the second hand 23 to the 0 second position, the stem 33, which is an example of the mode control means 30, is operated, so as to move the mode display hand 25 to the chronograph display position CNR, at which point the chronograph terminal of the control means 8 changes from the low level to the high level, the selector 87 of the function operation priority control circuit 83 changing so as to output the signal input to the A terminal thereof from the Q output thereof, and because the second hand 23 is not at the 0 second position, a low-level signal is generated from the zero detection circuit, this being input to 0 detection terminal of the control means 8.

As a result, the AND circuit 100 in the chronograph function display control circuit 82 of the control circuit 8 is opened, so that the 64-Hz pulse signal is passed through the AND circuit 100 and input to the terminal A of the selector 86.

Because a high-level signal is input to the Clear terminal of the control means 8, the selector 86 outputs the 64-Hz pulse signal input at the terminal A thereof to its Q output, thereby causing the second hand to be fast-forwarded up to the 0 second position.

In the case of returning from the chronograph display operating condition to the normal operating condition, because at low-level signal is input to the Chronograph terminal of the control means 8, the function operation priority control signal FPS changes to the high level.

That is, in this condition the signal SAD that is output from the energy-saving operating condition detection means 7 is set to the high level.

Therefore, the Non-coincidence terminal of the control means 8, to which is input the output signal from the non-coincidence circuit 65 is set to the high level, so that as a result a high-level signal is output from the OR circuit 93, this causing the 64-Hz pulse signal input to the terminal A of the selector 84 to be output from the Q output and input to the terminal B of the selector 87 provided in the function operation priority control circuit 83.

Because of the low level input to the control terminal C of the selector 87, the selector 87 outputs the 64-Hz pulse signal input to its terminal B at its Q output, so that the second hand 23 is fast-forwarded to the position indicating the current seconds.

In this configuration, when the energy-saving operating condition is operating, in the case in which the chronograph display function is used, the Chronograph terminal of the control means 8 changes to the high level, and the signal SAD output from the energy-saving operating condition detection means 7 is set to the low level.

As a result, the function operation priority control signal FPS output from the function operation priority control circuit 83 changes to the low level, and the power-saving control circuit 81 is completely shut down.

On the other hand, if the condition required for entering the energy-saving operating condition is satisfied, even if the signal SAD output from the energy-saving operating condition detection circuit 7 is at the low level, because the function operation priority control signal FPS output from the function operation priority control circuit 83 is at the low level, the power-saving control circuit 81 continues in the shutdown condition.

That is, in either of the cases noted above function information display operation from the function information generation means base on the function operating condition detection means is executed with priority over the display operation for the energy-saving operating condition, and the energy-saving operating condition display operation is either ignored or stopped.

Another example of the present invention is described below, with reference made to FIG. 6 through FIG. 9.

Figure 6:
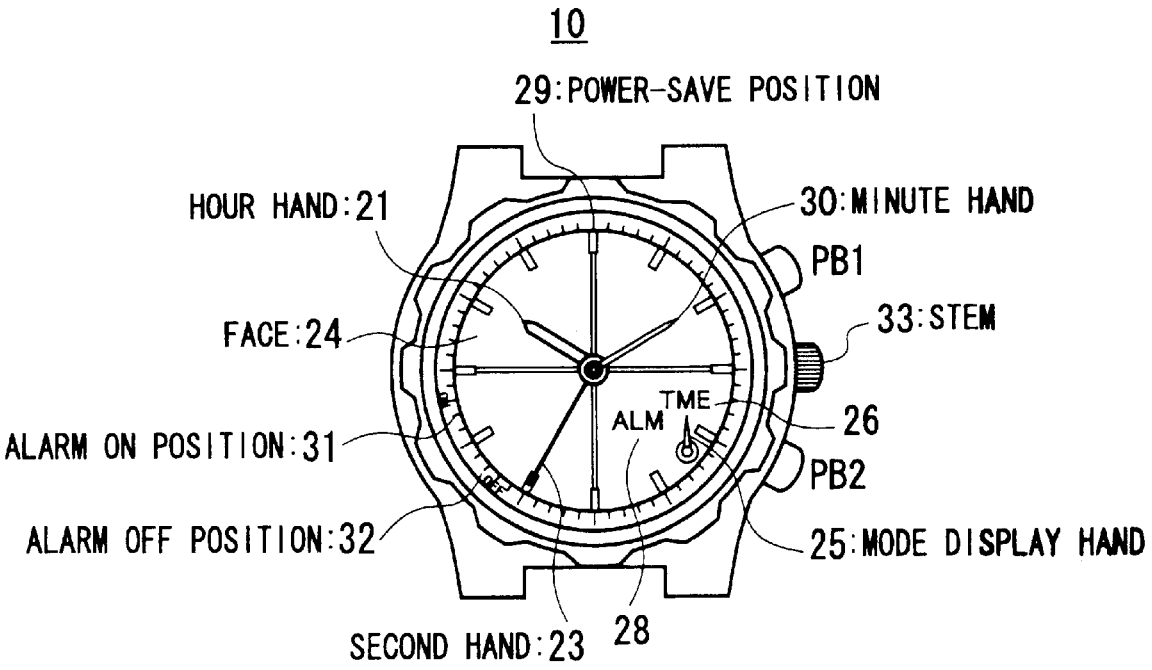
FIG. 6 is a circuit diagram showing an example of the configuration of the outer appearance of a second example of an electronic watch according to the present invention.

Specifically, this other example is an electronic watch 10 having a configuration such as shown in FIG. 6, with constituent elements the same as in the electronic watch 10 of FIG. 2 assigned the same reference numerals, the description of these elements being omitted herein.

In this other example, the configuration is such that the mode display hand 25 can take two different positions, a time information display position (TME) 26 indicating normal time information, and an alarm function display position (ALM) 28 for executing an alarm function.

The mode display hand 25 can be moved to a prescribed position by an operation of the stem 33.

In this example, when the mode display hand 25 is set to the alarm function display position (ALM) 28, so that the sounding of an alarm is enabled in the electronic watch 10, the second hand 23 moves to an alarm ON position 31, for example the 42-second position and stops, indicating that sounding of the alarm has been enabled.

In the case in which the sounding of the alarm has been disabled in the electronic watch 10, the second hand 23 moves to an alarm OFF position 32, for example the 38-second position and stops, indicating that the sounding of the alarm has been disabled.

Simultaneously, the hour and minute hands 21 and 22 are fast-forwarded to the set alarm time positions, enabling the user to know the set alarm time.

The alarm time can be altered by pulling out and rotating the stem 33.

Next, for another example of the present invention, as shown in the block diagram of FIG. 7, detection of an energy-saving operating condition and an alarm display function as an added function are described below.

Constituent elements that are the same as in the block diagram of FIG. 3 are assigned the same reference numerals, and are not described herein.

That is, in the control means 8, the case of causing the alarm display function, which is one function information to operate from the normal operating condition is considered.

Figure 7:
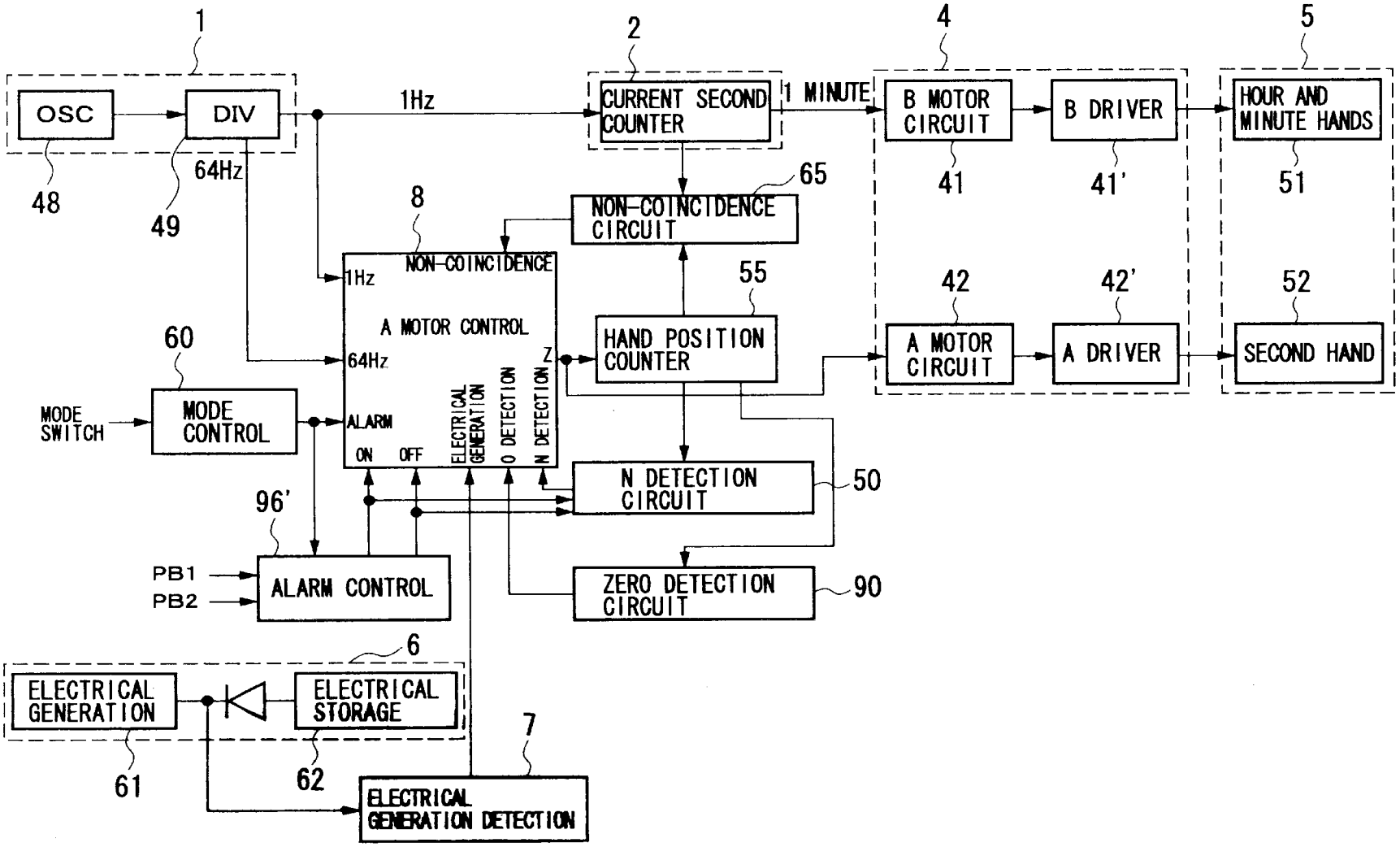
FIG. 7 is a block diagram showing a configuration of the second example of an electronic watch according to the present invention.

Of the circuit configuration in the example shown in FIG. 7, the part that is different from the block diagram of FIG. 3, in addition to the alarm function information generation means 96' replacing the chronograph display function control means 96, is the provision of an N detection circuit 50, which detects the value N of the hand position counter 55, and the elimination of the chronograph minute hand 30 and the display drive means 95, which drives the chronograph minute hand 30.

The N detection circuit 50 is set to 42 when movement is made to the alarm ON position 31, and is set to 38 when movement is made to the alarm OFF position 32.

Figure 8:
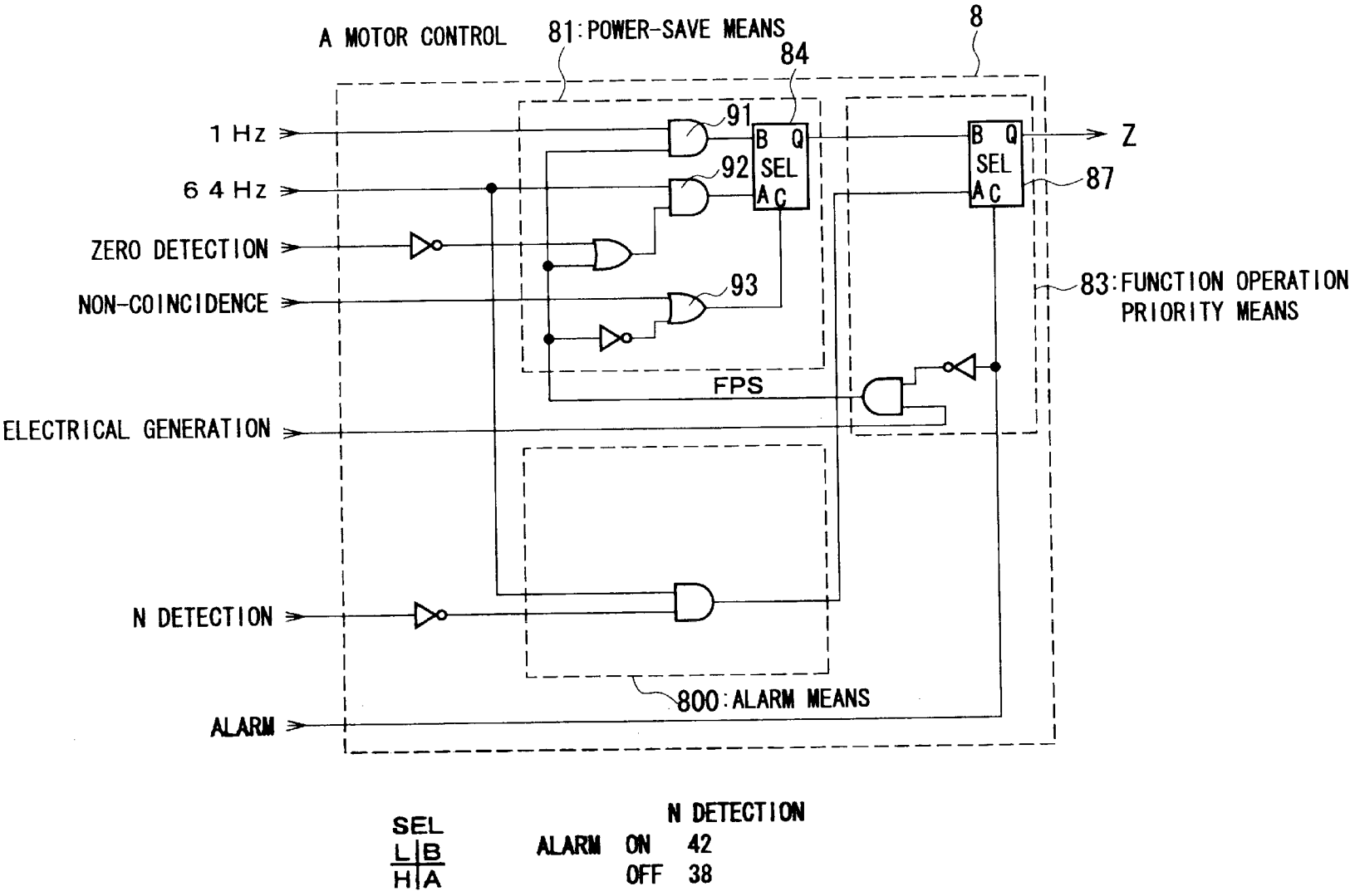
FIG. 8 is a block diagram showing a configuration of a control means in the second example of an electronic watch according to the present invention.

In this other example, a more specific configuration of the control means 8 that is used is shown in FIG. 8.

Constituent elements that are the same as in FIG. 4 are assigned the same reference numerals, and are not described herein.

The part of FIG. 8 that is different from FIG. 4 is that an alarm means 800 replaces the chronograph means 82, and the input of a signal from the N detection circuit 50.

Figure 9:
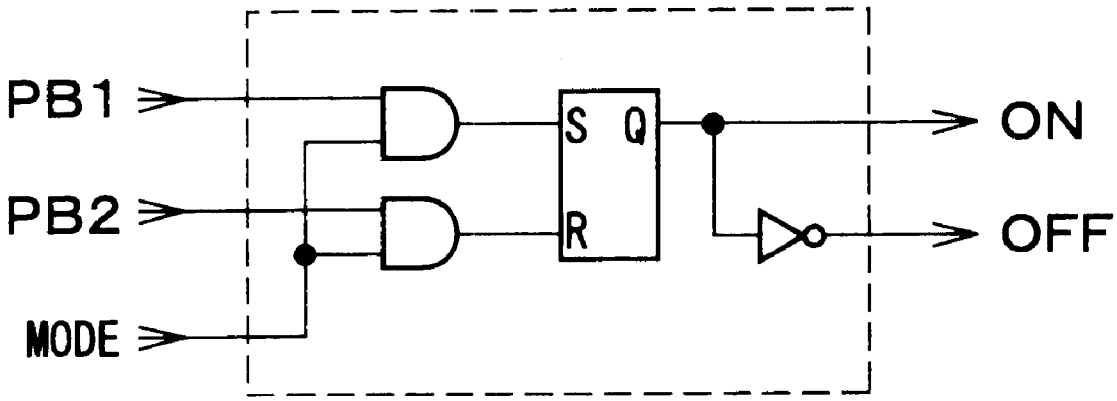
FIG. 9 is a circuit diagram showing an example of the configuration of an alarm control circuit used in the second example of an electronic watch according to the present invention.

As an example of the alarm function information generation means 96', as shown in FIG. 9 the output signals from buttons PB1 and PB2 and a selection signal according to the mode selection means 33 are input, this circuit outputting an ON signal indicating that the alarm function information generation means 96' is in the alarm sounding enabled condition, and an OFF signal indicating that the alarm function information generation means 96' is in the alarm sounding disabled condition, these being input to the ON and OFF terminals of the control circuit 8 and to the N detection circuit 50.

In the energy-saving operating condition, if the user wishes to use the alarm function, the user first operates the stem 33 in the example of the mode control circuit 60, so that the mode display hand 25 is moved to the alarm function position ALM 28.

By this operation, if the electronic watch 10 had already been set to the alarm sounding enabled condition, the second hand 23 moves to the alarm ON position 31, and if the electronic watch 10 had already been set to the alarm sounding disabled condition, the second hand 23 moves to the alarm OFF position 32.

In this condition, when the user pushes in an operating button of the electronic watch 10, such as the button PB1, if the second hand 23 had moved to the alarm ON position 31, it remains stopped.

If the second hand 23 had moved to the alarm OFF position 32, the second hand 23 moves to the alarm ON position 31.

In the same manner, if the button PB2 is pushed, if the second hand 23 had moved to the alarm ON position 31, the second hand moves to the alarm OFF position 32.

If, however, the second hand 23 had moved to the alarm OFF position 32, it remains stopped.

Although not illustrated, the alteration of the alarm time is possible by pulling out the stem 33 and rotating the hour and minute hands 21 and 22 by electromagnetic correction.

In this case, when setting the alarm function to the operating condition, in this example because the energy-saving operating condition had already been entered, the control means 8 cancels the energy-saving operating condition, and performs control so that the function operating condition display is given priority over the energy-saving operating condition display.

In this example, therefore, in the case in which an added function such as an alarm is in the function operating condition, even if the condition for entering the energy-saving operating condition is satisfied, this condition is ignored, and the added function such as the alarm only is given priority in being set to the operating condition.

In this example, in the case in which only the energy-saving operating condition is valid, as noted above the hour and minute hands 21 and 22 stop, and the second hand 23 can be in the stopped condition at the 0 second position, or with the hour and minute hands 21 and 22 in the normal watch operation mode, it is possible for the second hand only to be stopped at the 0 second position.

Next, as another example of an electronic watch and a drive method for an electronic watch according to the present invention, an example dealing with digital signals is described below.

Figure 10:
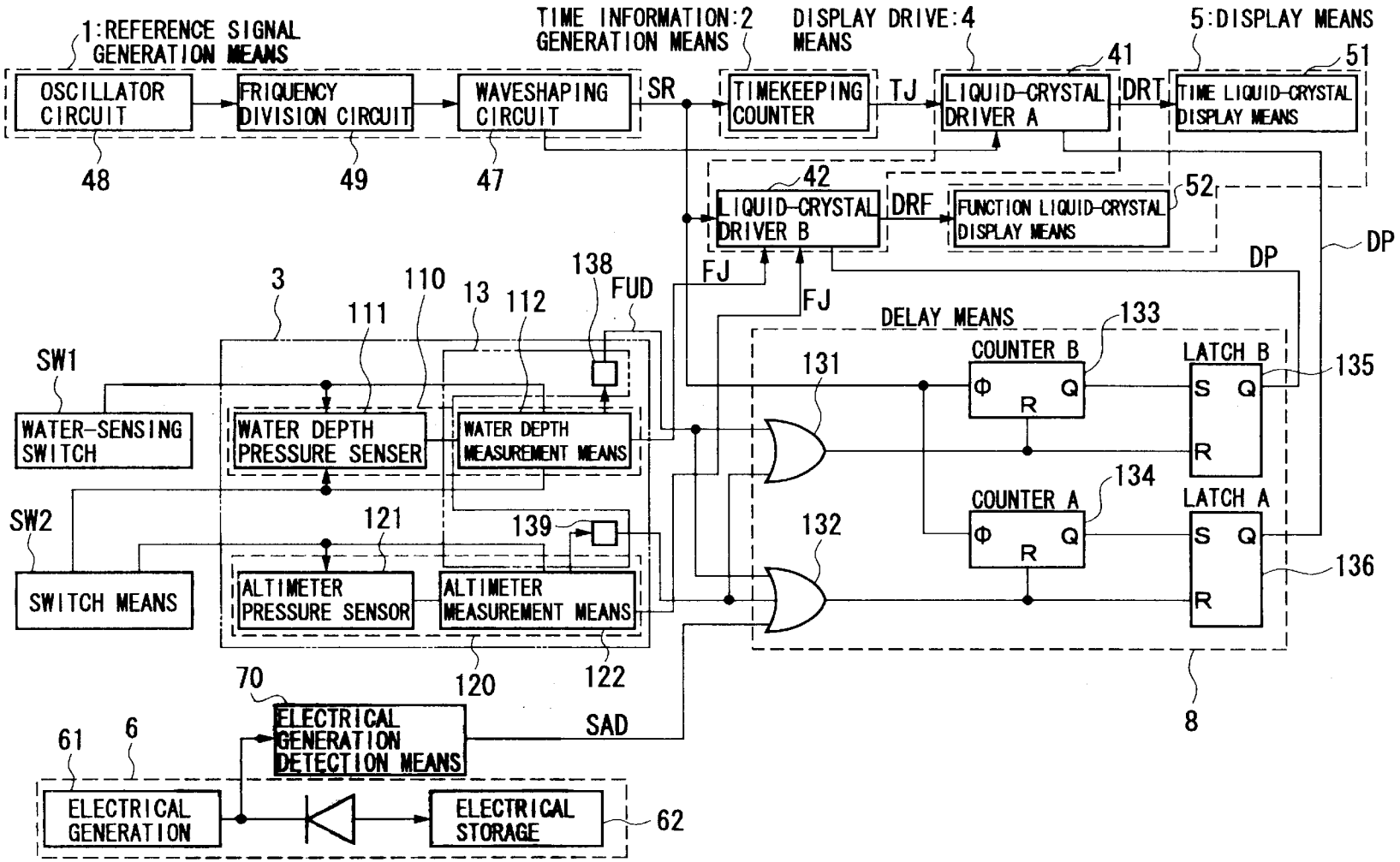
FIG. 10 is a block diagram showing a configuration of a third example of an electronic watch according to the present invention.

FIG. 10 illustrates a configuration having a liquid-crystal display for the display means, and having liquid-crystal driver for the display drive means and a separately provided time liquid-crystal display means 51, which displays the time, and a function liquid-crystal display means 52, which displays function operating information for an added function, this configuration further having a water depth measurement means 110 and altimeter measurement means 120 as added functions.

In FIG. 10 the configuration shown is provided with a reference signal generation means formed by an oscillator circuit 48, a frequency division circuit 49, and an appropriate wave-shaping circuit 47, a time information generation means 2, which generates time information based on a reference signal SR from the reference signal generation means 1, a function information generation means 3, which generates function information FJ, liquid-crystal drivers 41 and 42, which output drive signals DRT and DRF for the purpose of displaying appropriate time information on the time information display means 51 and function information on the function information display means 52, which display the time information TJ and the function information FJ, based on the drive signals DRT and DRF from the liquid-crystal drivers 41 and 42, and a control means 8, which from the function operating condition detection signal FUD from the detection circuits 138 and 139, which are a function operating condition detection means provided in the function information generation means 3, and an energy-saving operating condition detection signal SAD from the electrical generation means 70, which is an energy-saving operating condition detection means, performs control so as to give priority to the function operating condition in each display means, with respect to the energy-saving operating condition.

In this example, a water depth measurement function circuit means 110, which includes a water depth pressure sensor 111 and water depth measurement means 112, and an altimeter measurement function circuit means 120, which includes an altimeter measuring pressure sensor 121 and an altimeter measurement means 122 are provided, an appropriate water-sensing switch SW1 being provided as a switch means for the water depth measurement circuit means 110, and an appropriate switch SW2 being provided for the altimeter measurement function circuit means 120.

In this example, a switch means is also possible for the water depth gauge.

Additionally, the control means 8 in this example has a two-input OR circuit 131, to which are input the output signals from a water depth measurement function detection means 138 and an altimeter measurement function detection means 139, which are connected to the outputs from the water depth measurement function circuit means 110 and the altimeter measurement function circuit means 120, respectively, a three-input OR circuit 132, to which are input the output signals from the water depth measurement function detection means 138 and the altimeter measurement function detection means 139, as well as the energy-saving operating condition detection signal SAD from the electrical generation detection means 70, a first counter means 133 having a delay function, to the reset terminal of which is connected the output of the two-input OR circuit 131 and to the input terminal of which is connected the output signal of the reference signal generation means 1, a second counter means 134 having a delay function, to the reset terminal of which is connected the output of the three-input OR circuit 132, and to the input terminal of which is connected output signal of the reference signal generation means 1, a first latch means 135, to the set terminal of which is connected the output of the first counter means 133 and to the reset terminal of which is connected the output of the two-input OR circuit 131, and to the output of which is connected the liquid-crystal driver 42, which drives the function information display means 52, and a second latch means 136, to the set terminal of which is connected the output of the second counter means 134 and to the reset terminal of which is connected the output of the three-input OR circuit 132, and to the output of which is connected the liquid-crystal driver 41, which drives the time information display means 51.

In the control means 8, in the case in which the electronic watch 10 is in the normal operating condition, because a high level SAD signal indicating the condition in which normal electrical generation is being done is output from the electrical generation detection means 70 and outputs of both the water depth measurement function detection means 138 and the altimeter measurement function detection means 139 are at the high level, the output of the three-input OR circuit 132 is at the high level, so that the second counter 134 remains in the reset condition, although the second latch means is reset, so that a low level output signal is output from the output Q of the second latch means.

In this example, a low level signal output from the output Q of the latch means causes the liquid-crystal drivers 41 and 42 to drive, so that the liquid-crystal drive means is set so as to drive the display, while a high level signal output from the output Q of the latch means indicates the energy-saving mode, and makes a setting so as to stop the display drive of the liquid-crystal display means.

In the above-noted case, therefore, the time liquid-crystal display means 51 is display driven.

The first counter 131 is released from its reset condition by the low level signal output from the two-input OR circuit 131, and starts to count, and when it counts up to a pre-established count, because the output of the first counter is input to the set terminal of the first latch means 135, a high level signal is output from the output of the latch means 135, the result being that the driving operation of the liquid-crystal driver 42 of the function information display means 52 is stopped, resulting in the drive of the time information display means, the function information display means display being stopped.

That is, in the case of normal electrical generation operation, the display condition of only the time information display means 51 is maintained.

Either or both of the function information generation means 110 or 120 is operated via the switch means SW1 or SW2. In particular in the case of FIG. 13, for water depth measurement and water temperature measurement, because the output signals of one or both of the water depth measurement function detection means 138 and the altimeter measurement function detection means 139 are at the high level, the outputs of both the two-input OR circuit 131 and the three-input OR circuit 132 change to the high level, and for the above-noted reason the outputs of both the first and the second latch means 135 and 136 change to the low level, resulting in the display drive of both the time information display means 51 and the function information display means 52.

Next, in the case in which neither the function information generation means 110 nor 120 operates and electrical generation is not being done, the output from the electrical generation detection means 70 changes to the low level, so that the outputs of the means 138 and 139 are also low level, resulting in the output of the three-input OR circuit 132 changing to the low level, so that the reset condition of the second counter 134 is released by the low level signal output from the three-input OR circuit 132, whereupon it starts counting and, when it has counted up to a pre-established count, because the output of the second counter 134 is input to the set terminal of the second latch means 136, a high-level signal is output from the latch means 136, thereby placing the time liquid-crystal display means 51 into the energy-saving operating condition, so that the display operation thereof stops.

During this period, the display operation of the function information display means 52 also stops.

Next, when the display operation of the time information display means 51 is stopped in the energy-saving operating condition, if an operation is performed on the function information generation means, the output of the three-input OR circuit 134 is forcibly changed to the high level, so that, as is clear from the above-noted description, the output signal of the second latch means 136 changes to the low level, thereby resulting in the release of the energy-saving operating condition of the time information display means 51, so that it executes display of the time.

During the time when the function operating condition is being executed, even if it becomes necessary to drive the energy-saving operating condition, the output of the three-input OR circuit 132 is maintained at the high level so that, as is clear from the above-noted description, the output signal of the second latch means 136 is also maintained at the low level, so that the time information display means 51 remained in the condition in which it is released from the energy-saving operating condition, so that the time display is maintained.

Thus, in this case energy-saving operation is not done.

Figure 11:
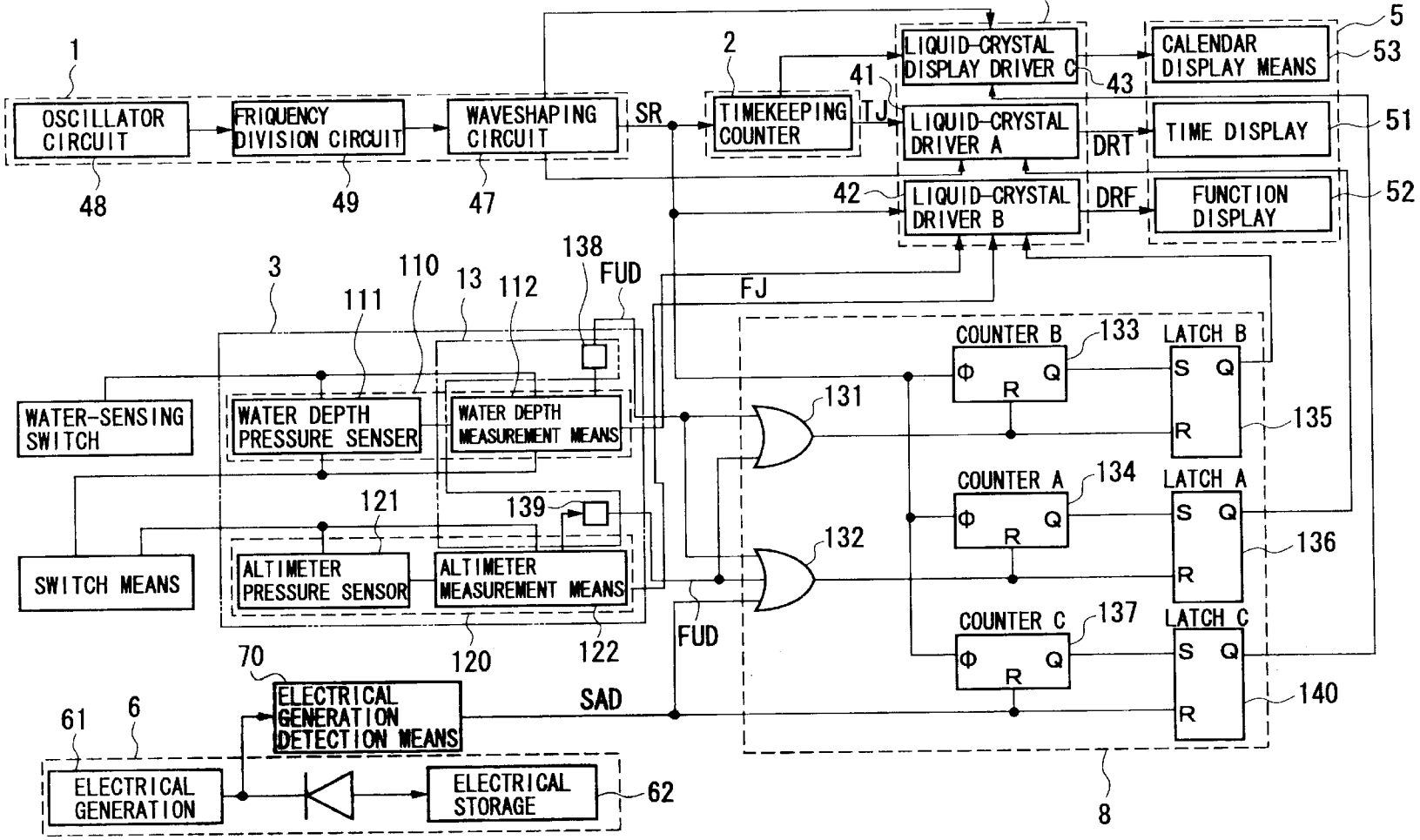
FIG. 11 is a block diagram showing a configuration of a fourth example of an electronic watch according to the present invention.

Next, a fourth example of the present invention is described, with reference being made to FIG. 11.

Specifically, the basic configuration shown in FIG. 11 is the same as in FIG. 10, except that three types of display means are used, one of these display means being controlled directly by the energy-saving operating condition detection signal SAD from the electrical generation detection means 70, regardless of the existence or non-existence of a function display operating condition.

That is, in this example, as shown in FIG. 11, there is additionally provided a liquid-crystal display means 53 for a calendar display and a liquid-crystal driver 43 to drive this, as well as a third counter 137 and a third latch means 140 connected thereto, this third counter 137 having its reset terminal connected to the electrical generation detection means 70, and having the output signal from the reference signal generation means 1 connected to its input, the output of the counter 137 being input to the set terminal of the third latch means 140.

The third latch means 140 has its reset terminal connected to the electrical generation detection means 70, and its output terminal connected to the liquid-crystal driver 43.

Because the basic operation of this example, therefore, is approximately the same as the example of FIG. 10, its detailed description will be omitted. However, the newly provided calendar display means 53, the latch means 140 being unrelated to the output signal of the function operating condition detection means 13, is driven by the output signal from the electrical generation detection means 70, so that regardless of whether or not there is a function operating condition, the display means is placed into the energy-saving operating mode or placed into the normal display mode.

As is clear from the above-noted description of this example, in the present invention it is preferable to further provide a delay means for counting a prescribed delay time after a condition for entering the energy-saving operating condition is satisfied, and then control is performed for transitioning from the normal operating condition to the energy-saving operating condition, and desirable that the configuration be such that this delay means is reset in the case in which the function information generation means goes into the operating condition.

In this example, it is desirable that during the time the function information generation means is in the operating condition, the delay means is reset.

Another example of the present invention is a method for drive in an electronic watch having a reference signal generation means, a time information generation means, which generates time information based on a reference signal from the reference signal generation means, a function information generation means, which generates function information, a display drive means, which outputs a drive signal for display of the function information and the time information, and a display means, which displays the time information and the function information, based on the drive signal from the display drive means, this electronic watch having a energy-saving operating condition with a power consumption that is less than a normal operating condition, whereby control is performed to give priority to the function operating condition of the function information generation means over the energy-saving operating condition.

A more detailed example of the electronic watch drive method according to the present invention can be an electronic watch drive method for an electronic watch having a reference signal generation means, a time information generation means, which generates time information based on a reference signal from the reference signal generation means, a function information generation means, which generates function information, a display drive means, which outputs a display drive signal for display of the function information and the time information, and a display means, which displays the function information and the time information, based on the drive signal from the display drive means, this electronic watch having an energy-saving operating condition with a power consumption that is less than a normal operating condition, whereby in the case in which the function information generation means changes to the operating condition during the energy-saving operating condition, control is performed so that the energy-saving operating condition is cancelled. An example of the electronic watch drive method according to the present invention can also be a watch drive method for an electronic watch having a reference signal generation means, a time information generation means, which generates time information based on a reference signal from the reference signal generation means, a function information generation means, which generates function information, a display drive means, which outputs a display drive signal for display of the function information and the time information, and a display means which displays the function information and the time information, based on the drive signal from the display drive means, this electronic watch having an energy-saving operating condition with a power consumption that is less than a normal operating condition, wherein even if a condition for entering the energy-saving operating condition is satisfied during the normal operating condition of the function information generation means, control is performed so that the energy-saving operating condition is not entered.

Further, in the drive method for an electronic watch according to the present invention, in the case in which the operating condition of the function information generation means is stopped, the display drive means can be configured so that it drives either the time information display means in either the normal operating condition or the energy-saving operating condition, and in the case in which either the output voltage or the output current of the power supply means is judged to be insufficient to place the time information generation means in the operating condition, the configuration is such that the display of the function information display means is stopped.

Figure 12:
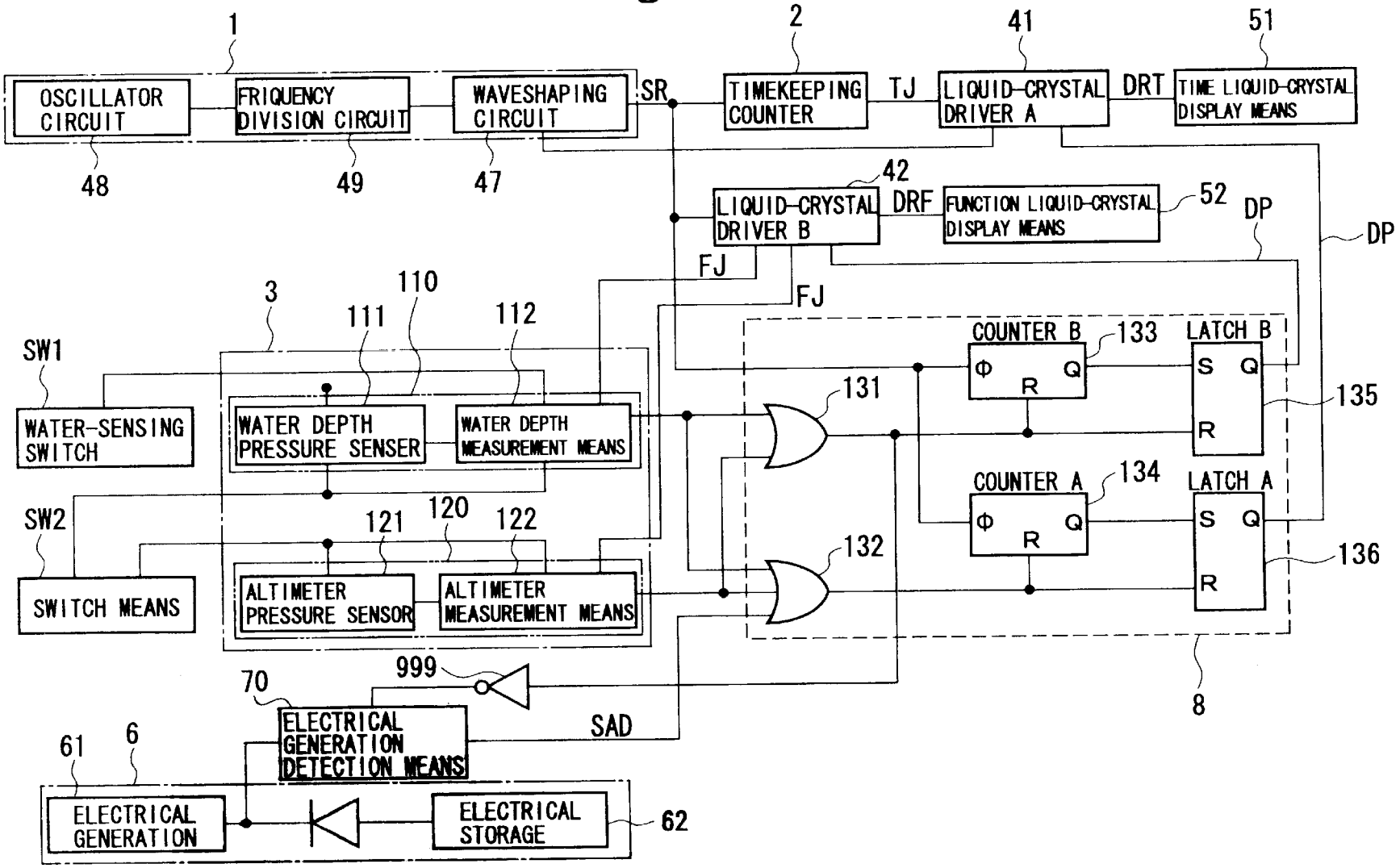
FIG. 12 is a block diagram showing a configuration of a fifth example of an electronic watch according to the present invention.

FIG. 12 illustrates a configuration of a fifth example of the present invention, in which the display means is changed to a liquid-crystal display apparatus, and the display drive means is changed to a liquid-crystal driver, a liquid-crystal display means displaying the time information and a function operating condition display means display the function information being separately provided, and a water depth gauge means and altimeter measurement means being used as added functions, in the same manner as shown in the third example of FIG. 10.

In FIG. 12, elements that are the same as ones in the third example of FIG. 10 are assigned the same reference numerals, and are not described herein.

In this drawing, the inverter 999 has an output signal of the OR circuit 131 as an input, and when one of the water depth gauge means or altimeter measurement means is operating, the OR circuit 131 output changes to the high level, and the inverter 999 output changes to the low level, so that the detection operation of the electrical generation detection means 70, which is an energy-saving operating condition detection means, is stopped, this being different than the third example shown in FIG. 10.

In the first example of FIG. 3 as well, when the mode control circuit 60 is currently outputting an instruction other than the chronograph mode, control is performed so that of the circuitry within the control means 8, non-chronograph mode circuitry is stopped, so that as the energy-saving operating condition, not only part or all of the display means 5, but also circuitry of the IC circuitry of the electronic watch that is not required to operate for the various modes is stopped, thereby achieving an effective energy-saving method.

Figure 13:
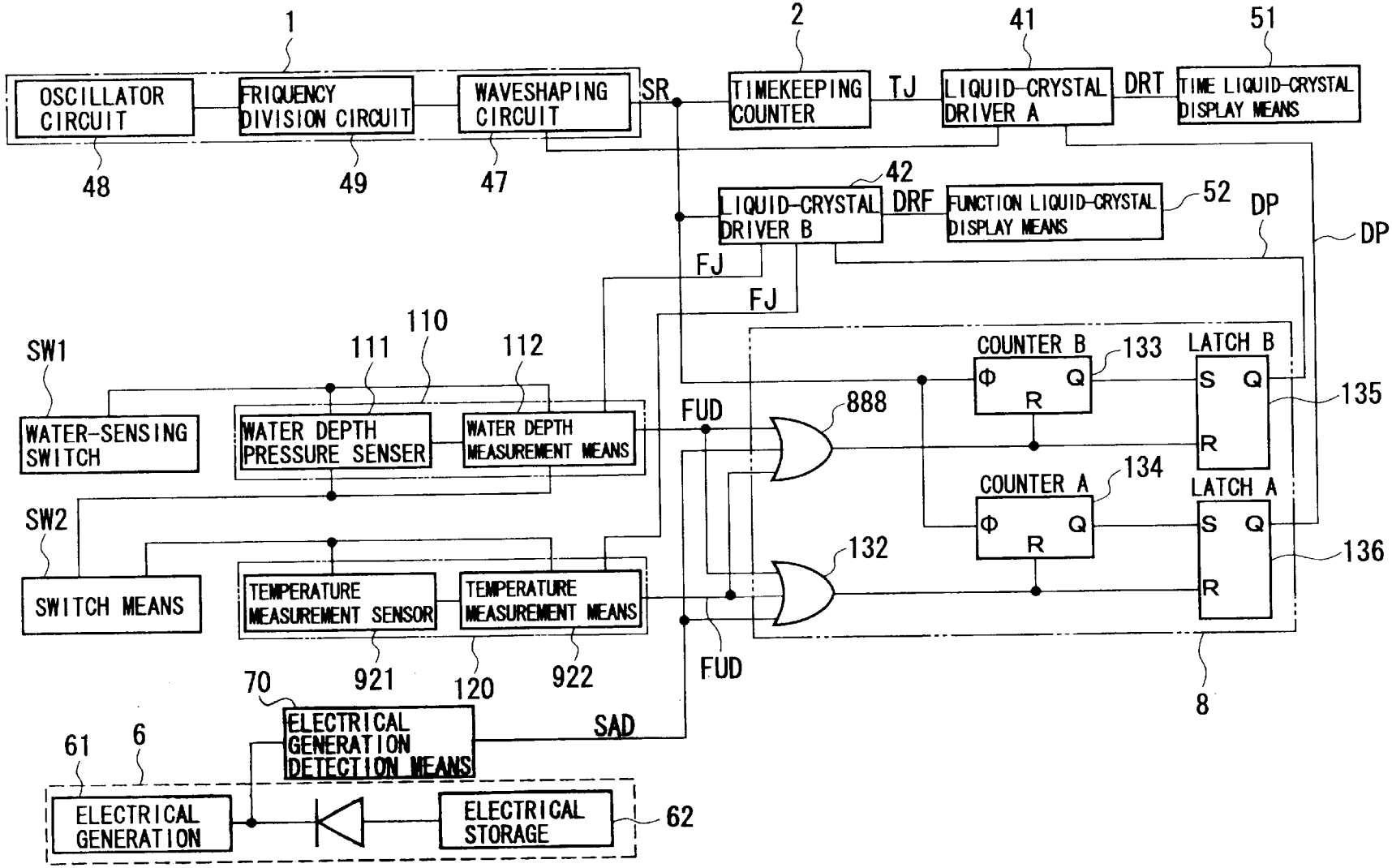
FIG. 13 is a block diagram showing a configuration of a sixth example of an electronic watch according to the present invention.

FIG. 13 illustrates a configuration of a sixth example of the present invention, in which the display means is changes to a liquid-crystal display apparatus, and the display drive means is changed to a liquid-crystal driver, a liquid-crystal display means displaying the time information and a function operating condition display means display the function information being separately provided, and a water depth gauge means and water temperature measurement means being used as added functions.

While in the third example of FIG. 10, the function liquid-crystal display means 52 display is extinguished when not using the added function, regardless of whether the electrical generation means 61 is generating or not generation electricity, in the sixth example of FIG. 13, when the electricity is being generated, similar to the time liquid-crystal display means 51, the function liquid-crystal display means 52 also is not extinguished.

In order to change to above-noted specifications, in place of the OR circuit 131 of FIG. 11, the OR circuit 888 is used, this having the signal SAD as an added input.

In FIG. 13, elements that are the same as elements in the third example of FIG. 10 are assigned the same reference numerals, and are not described herein.

In addition, the difference with respect to the third example of FIG. 10 is the use of a temperature measurement function, including water temperature measurement, in place of the altimeter measurement function, and the provision of a temperature sensor 921 and a temperature measurement means 922 for temperature measurement.

Although in FIG. 13 the water depth measurement and water temperature measurement (temperature measurement) are independent operations, it is also possible, based on the water-sensing switch SW1, to cause simultaneous execution of water depth measurement and water temperature measurement.

Next a further seventh example of the present invention is described, with references made to FIG. 14 through FIG. 17.

Specifically, the seventh example of the present invention is an electronic watch and a drive method for a electronic watch having a configuration wherein in the energy-saving operating condition the condition for placing the function information generation means into the function operating condition is different from the function operating condition in the normal function information generation means, and more specifically if the function information generation means enters the function operating condition when in the energy-saving operating condition, the function operating time in the function information generation means is set so as to be shorter than the function operating time in the normal condition in the function information generation means.

Specifically that is, in an example in which the function information generation means has a chronograph function, a chronograph display of less than a second can be changed from the normal drive time of, for example, 3 minutes, to a drive time of 1 minute during power-save, and in the case in which the function information generation means has an alarm function, if the normal sounding time of the alarm is, for example, 15 to 20 seconds, drive can be done to set the alarm sounding time to 10 seconds.

Figure 14:
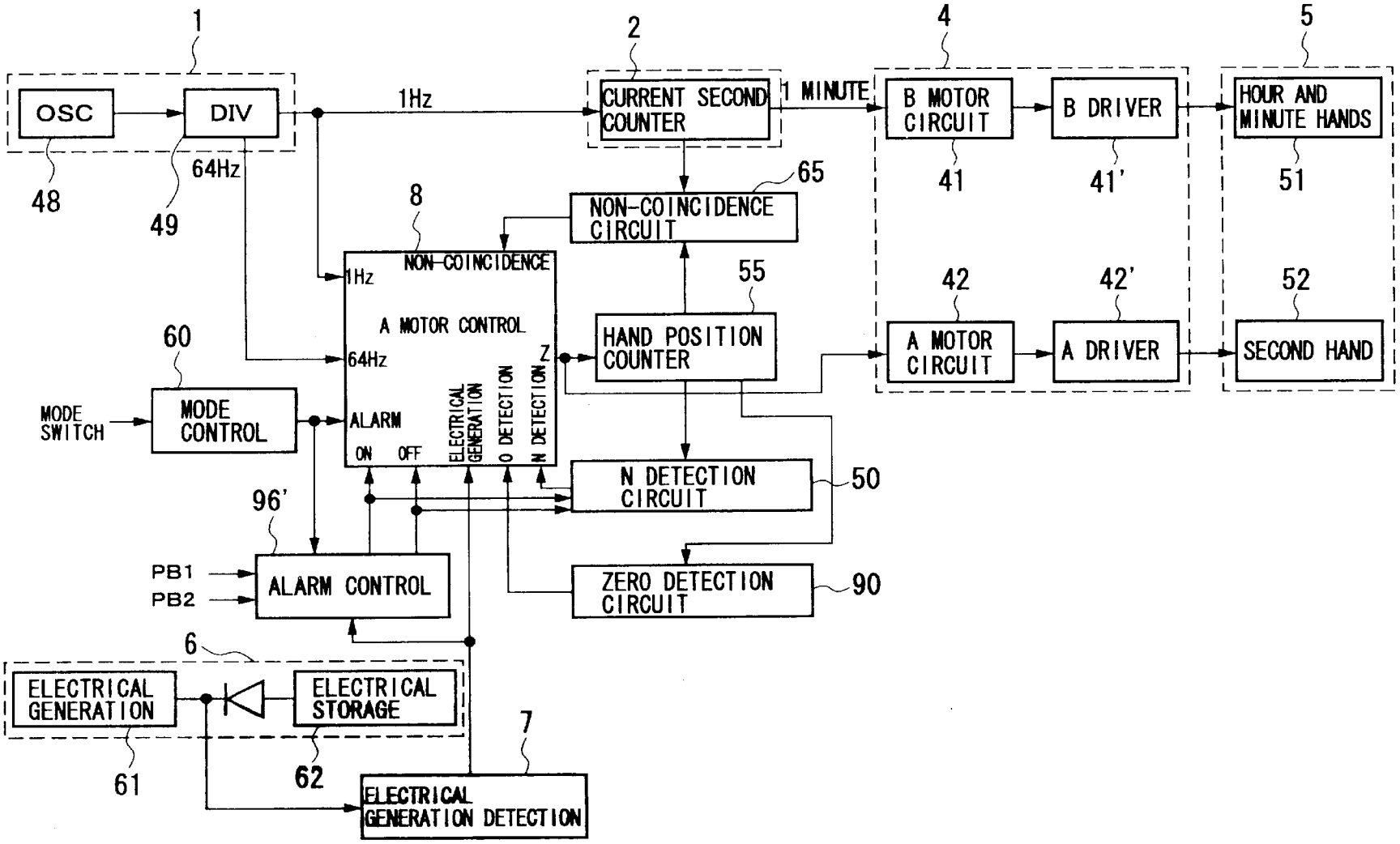
FIG. 14 is a block diagram showing a configuration of a seventh example of an electronic watch according to the present invention.

The basic circuit configuration of this example is as shown in the block diagram of FIG. 14, and because this is basically the same configuration as in the block diagram shown in FIG. 7, elements that are the same as in FIG. 7 are assigned the same reference numerals and are not described herein.

However, difference in the configuration of the block diagram of FIG. 14, which shows this example with respect to the block diagram of FIG. 7 is that an output signal from the electrical generation detection means, which is an energy-saving operating condition detection means, is input to an alarm control means 96', which is a function information generation means.

By adopting this configuration, it is possible to judge whether or not the function operating condition of the function information generation means is being executed during the energy-saving operating condition.

This control can be easily implemented using, for example, a microprocessor.

Specifically, in the example in which the function information generation means has an alarm function, the operating procedure is described below, referring to the flowcharts shown in FIG. 15 and FIG. 16.

Figure 15:
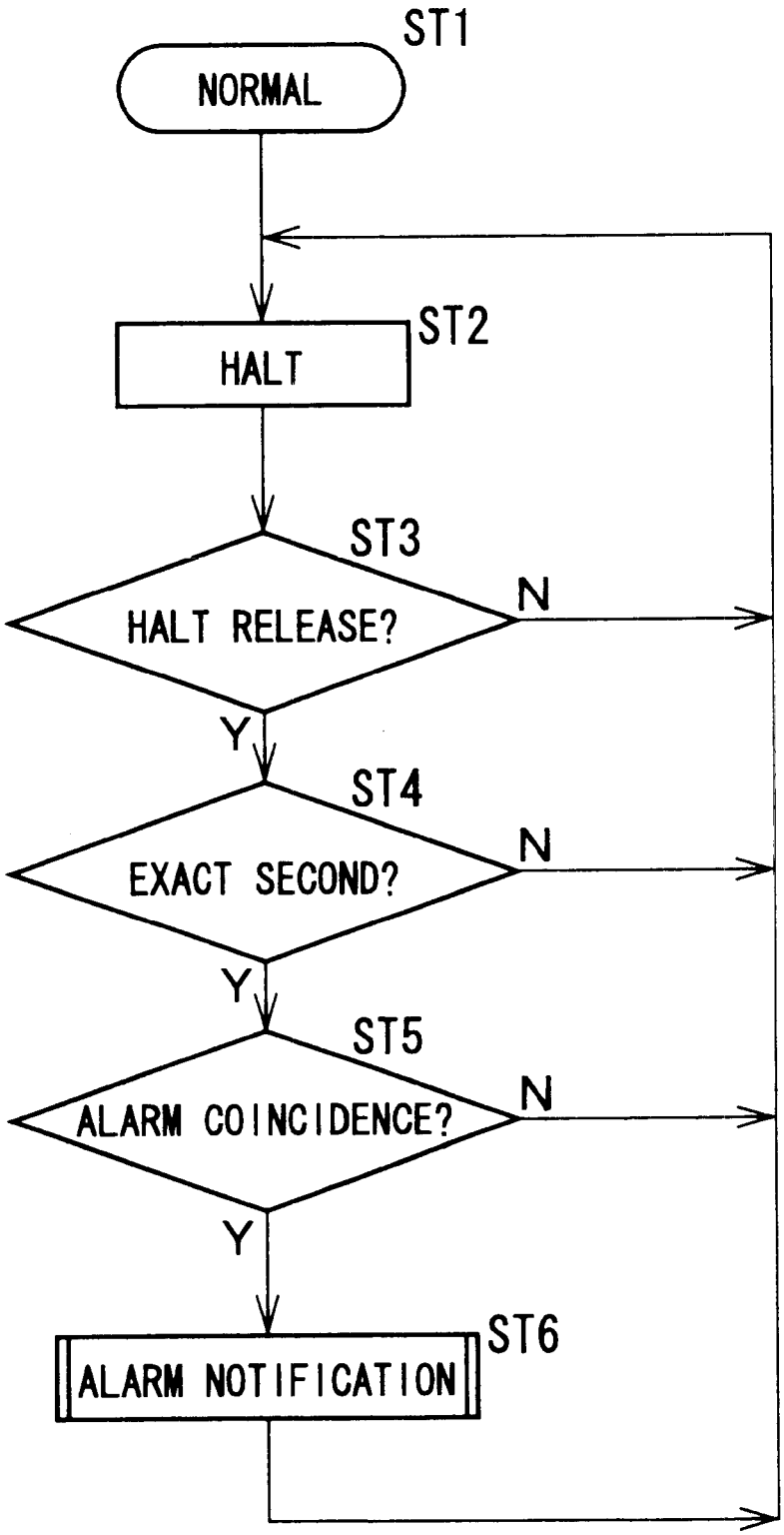
FIG. 15 is a flowchart illustrating an operating procedure in the seventh example of an electronic watch according to the present invention.
Figure 16:
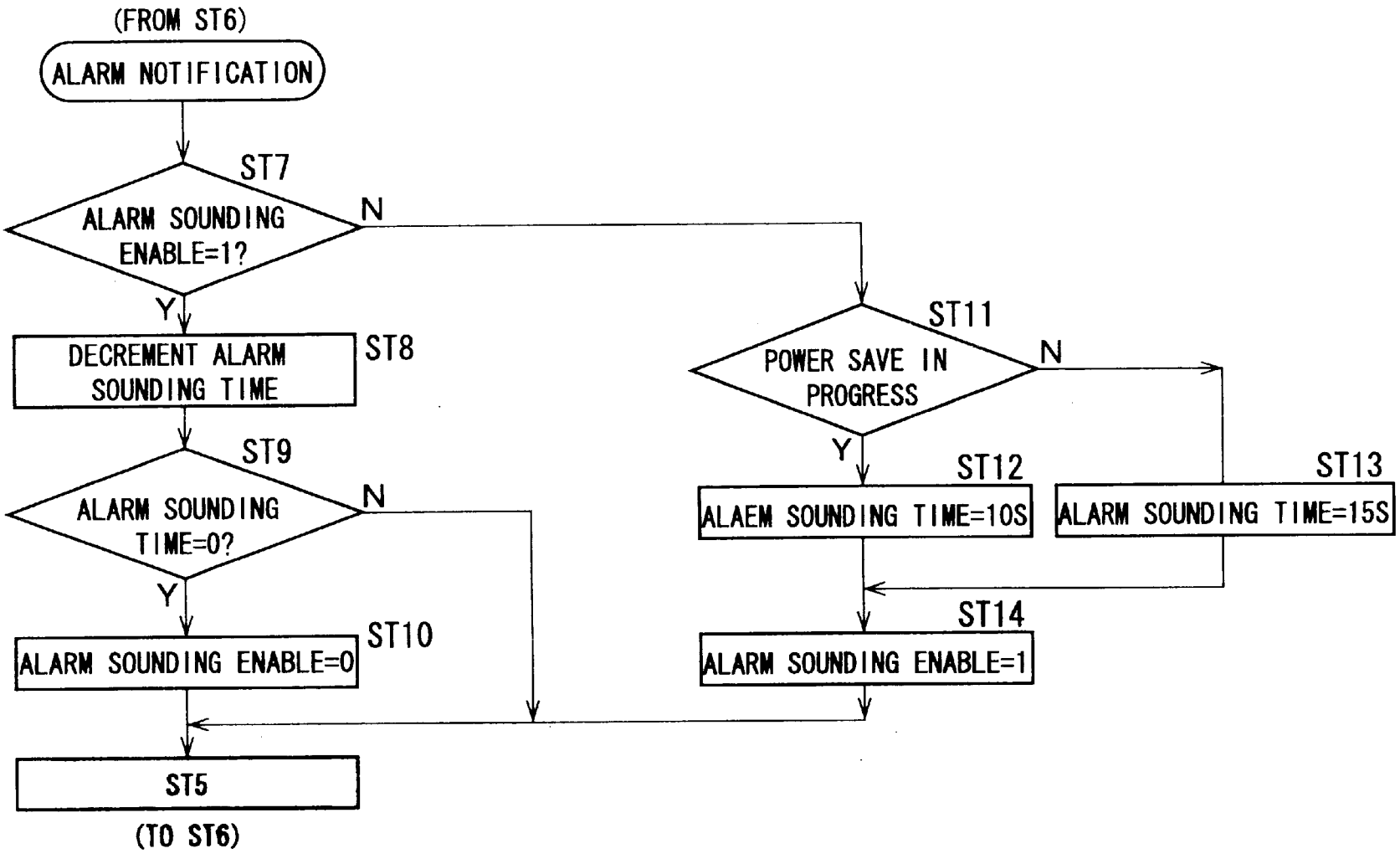
FIG. 16 is a flowchart illustrating an operating procedure in the seventh example of an electronic watch according to the present invention.

Specifically, first in the main flowchart of FIG. 15, at step ST1, after instructing for execution of normal control, at step ST2 the microprocessor is maintained in the halted condition.

After the above, at step ST3 a reference signal of, for example, 0.5 second is generated, so as to verify whether or not the microprocessor is released from the halted condition (halt release).

At step ST3, if the result is NO, return is made to step ST2, and the above-noted process is repeated. If the result is YES, however, control proceeds to step ST4, at which, for example, a judgment is made of whether or not the time is precisely on a second mark (for example, a judgment as to whether two 0.5-second reference signals have occurred) and, if the result of this judgment is YES, control proceeds to step ST5 at which a judgment is made as to whether or not time information coincides with a pre-established alarm condition information and, if the result of this judgment is NO, return is made to step ST2, from which the above-noted processing is repeated. If the result is YES, however, control proceeds to step ST6, at which the subroutine shown in FIG. 16 with regard to alarm notification is executed.

That is, first at step ST7, a judgment is made as to whether or not the alarm sounding enable flag is 1 and because in this initial condition the alarm sounding enable flag is set to 0, control proceeds to step ST11, at which a judgment is made as to whether or not the current condition is the power-saving condition and, if the result of this judgment is NO, control proceeds to step ST13, at which the alarm sounding time is the normal alarm sounding time. For example, the setting is made to 15 seconds, and control proceeds to step ST14, at which the alarm sounding enable flag is set to 1.

If the result at step ST11 is YES, however, that is, in the case of the power-saving condition in progress, at step ST11 the alarm sounding time is set to a time that is shorter than the normal alarm sounding time, for example, to 10 seconds, whereupon control proceeds to step ST14, at which the alarm sounding enable flag is set to 1, and return is made to step ST6.

In the case in which the subroutine is executed, because the alarm sounding flag is set to 1, the result is YES at step ST7, whereupon control proceeds to step ST8, at which, based on the alarm sounding time set at either step ST11 or step S12, the alarm sounding time is decremented.

After the above, control proceeds to step ST9, at which a judgment is made as to whether or not the alarm sounding time has reached zero and, if the result of this is NO, return is made to step ST6, but if the result of this is YES, control proceeds to step ST10, at which the alarm sounding enable flag is reset to 0, whereupon return is made to step ST6.

Figure 17:
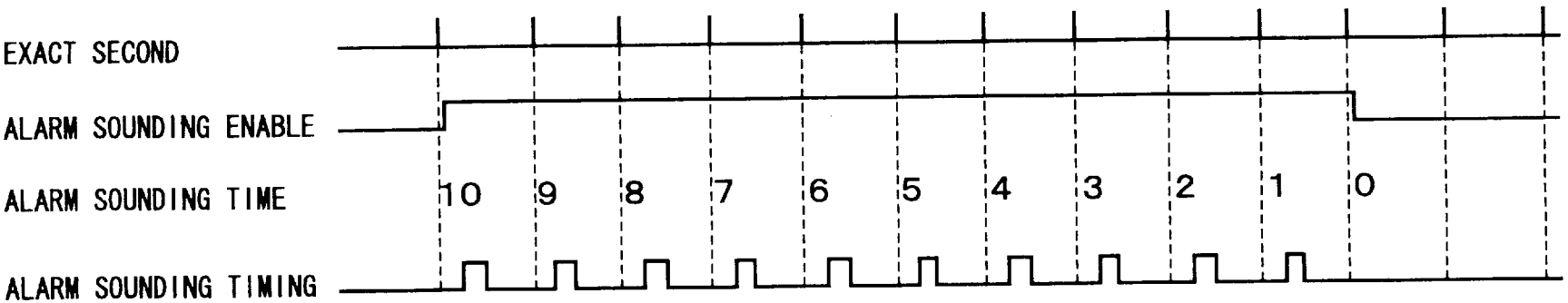
FIG. 17 is a timing diagram in the seventh example of an electronic watch according to the present invention.

FIG. 17 shows a, specific timing diagram for the above.

In the example shown in FIG. 17, the timing diagram is for the case in which with the generated clock at an exact second (1 second), the sounding time in accordance with the sounding enable flag is 10 seconds.

That is, within the sounding enabled time period, a sounding timing signal is input in response to generation of a precise second, so as to generate an alarm.

Next, an eighth example of the present invention is described below, with reference to FIG. 18.

That is, in this example during the energy-saving operating condition the configuration is such that when the operating condition of the function information generation means in the function operating condition ends, if the condition for entering the energy-saving operating condition are maintained as before, there is immediate return to the energy-saving operating condition.

By adopting this configuration, the function information generation means goes into the function operating condition during the energy-saving operating condition and when the function information generation means subsequently stops the function operating condition, a judgment is made by the function information generation means as to whether or not the energy-saving operating condition is continued, but when the condition for entering the energy-saving operating condition exists, the energy-saving operating condition (power-saving) is immediately entered.

Figure 18:
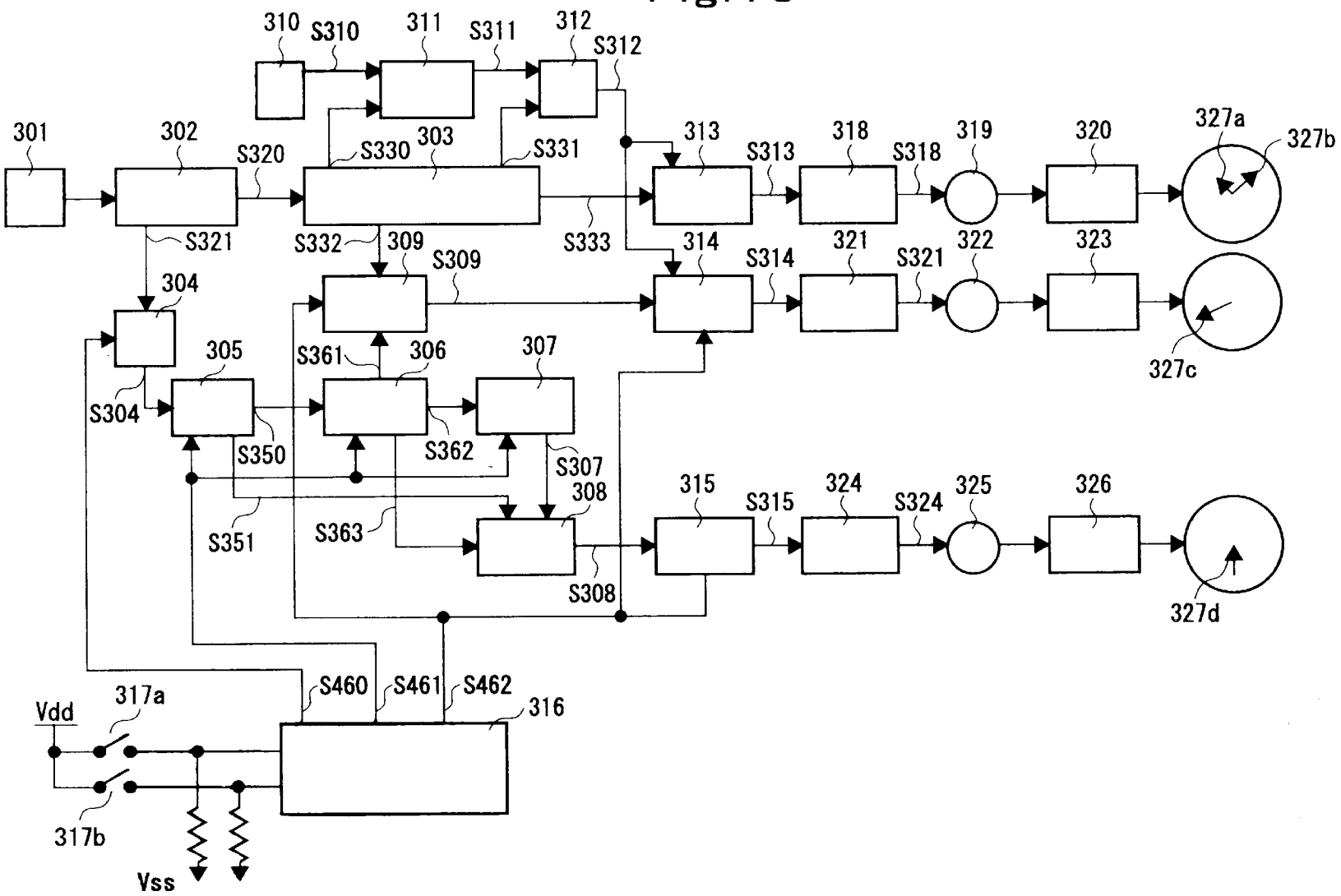
FIG. 18 is said block diagram showing an eighth example of an electronic watch according to the present invention.

A detailed circuit configuration of the eighth example is shown in the block diagram of FIG. 18.

In FIG. 18, 301 is an oscillator, and 302 is a frequency divider, which outputs a 1-Hz signal S320 and a 10-Hz signal S321.

303 is a timekeeping circuit, which outputs a 1-minute signal S330, a 0 h 00 m detection signal S331, second hand information S332, and timing information S333.

304 is a gate circuit, which outputs a chronograph 10-Hz signal S304.

305 is a chronograph 1/10-second counter, which outputs a chronograph 1-second signal S350 and a chronograph 1/10-second signal S351.

306 is a chronograph second counter, which outputs chronograph second information S361, a chronograph 1-second signal S362, and a 1-second-or-greater signal S363.

307 is a chronograph counter, which outputs chronograph minute information S307.

308 is a switching circuit A, which inputs the chronograph minute information S307 at the 1-second-or-greater signal S363, and also outputs timekeeping information A S308.

309 is a switching circuit B, which inputs the chronograph second information S361 at the chronograph mode signal S462, and also outputs timekeeping information B S309.

310 is an electrical generation means, which outputs an electrical generation signal S310.

311 is a timekeeping counter, which counts the non-electrical generation time, and after a prescribed amount of time, outputs a non-electrical generation condition signal S311.

312 is a fixed-time time detection circuit, which after inputting the non-electrical generation condition signal S311, when the 0h 0m detection signal S331 is input, outputs a conversion stop signal S312.

313 is a hand position conversion circuit A, which converts the time information S333 to a hand position, and which outputs hand position information A S313 and stops conversion by the conversion stop signal S312.

314 is a hand position conversion circuit B, which converts the time information B S309 to a hand position, and which outputs hand position information B S314, and stops conversion by the conversion stop signal S312.

By a chronograph mode signal S462, however, the stopping is cancelled and the chronograph is executed with priority.

315 is a hand position conversion circuit C, which converts the timekeeping information A S308 to a hand position, and which outputs hand position information C S315 and which converts by the chronograph mode signal S304.

316 is a mode selection circuit, which outputs a start/start signal S460, a reset signal S461, and a chronograph mode signal S462.

317*a* and 317*b* are switches which operated in concert with an external operating member.

318 is a converter drive circuit A, which is formed by a storage circuit and a comparator circuit, and which inputs the hand position information A S313, and outputs a drive pulse S318 to the extent of the change in the hand position information A S313.

319 is a stepping motor A.

320 is a speed-reduction gear train A, for the purpose of driving a minute hand 327*b* and an hour hand 327*a* supported by a minute gear and an hour gear that make up part thereof.

321 is a converter drive circuit B, which is formed by a storage circuit and a comparator circuit, and which inputs the hand position information B S314, and outputs a drive pulse S321 to the extent of the change, in the hand position information B S314.

322 is a stepping motor.

323 is a speed reduction gear train B, for the purpose of driving a second hand 327*c* supported by a second gear.

324 is a converter drive circuit C, which is formed by a storage circuit and a comparator circuit, and which inputs the hand position information C S315 and outputs a drive pulse S324 to the extent of the change in the hand position information C S315.

325 is a stepping motor.

326 is a speed reduction gear train C, for the purpose of driving a chronograph second and 327*d* supported by a chronograph second gear.

In this example, in order to achieve the above-noted object, first in the output condition of the output signal from the electrical generation means 310 is counted in the timekeeping counter 311, using the 1-minute signal S330 output from the timekeeping. circuit 303 as a clock, the period during a condition in which the output from the electrical generation detection means 310 is not arriving being counted, and in the case in which that condition continues for a prescribed amount of time, a control signal such as a high level non-electrical generation condition detection signal S311 is output for a prescribed amount of time to indicate that the non-electrical generation condition was detected for the prescribed amount of time.

This prescribed-time non-electrical generation condition detection signal S311 is input to the fixed-time time detection circuit 312, and at the fixed-time time detection circuit 312, in response, for example, to a 0h 0m detection signal S331, which is output every 24 hours, a high-level fixed-time non-electrical generation signal S312 is output to the hand position conversion circuit A 313 that controls the hour and minute hands and the hand position conversion circuit B 314, which controls the second hand that is shared with the chronograph, the result being that the conversion processing operation of the hand position conversion circuit A 313 and the hand position conversion circuit B 314 is caused to stop.

That is, in the energy-saving operating condition the drive of each hand is stopped.

However, as described above, in accordance with the basic technical constitution of the present invention, because a function information generation command signal, for example, the chronograph mode signal S462 output from the mode selection circuit 316, which is a chronograph function information generation command signal, is input to the hand position conversion circuit B 314, and because in the case in which the chronograph mode signal S462 is input to the hand position conversion circuit B 314 the chronograph mode signal S462 is set so as to give priority to the fixed-time non-electrical generation detection signal S312, at the hand position conversion circuit B 314 the fixed-time non-electrical generation detection signal S312 is ignored, so that the function information generation means continues in the function operating condition regardless of the energy-saving operating condition.

Next, because the chronograph mode signal S462 is converted from a high level to a low level in the chronograph mode from the mode selection circuit 316, even should the output of the high-level fixed-time non-electrical generation detection signal S312 continue at this point, because the output of the fixed-time non-electrical generation detection signal S312 is valid, return is made to the power-saving condition, in which the time display function is stopped.

That is, in the present invention the electronic watch when an added function such as a chronograph is used during the power-saving condition and then after use of the added function the condition for entering the power-saving condition exists, return is immediately made once again to the power-saving condition.

By adopting the above-described technical constitution, an electronic watch and drive method for an electronic watch according to the present invention provide, in a multi-function electronic watch capable of providing a variety of added function information, facilitate the implementation of an electronic watch and drive method having a high value as a product, which can separately use a energy-saving mode and a function information operating mode.

What is claimed is:

1. An electronic watch comprising a reference signal generation means, a time information generation means for generating time information based on a reference signal from said reference signal generation means, a function information generation means for generating function information, a display drive means, which outputs a drive signal for displaying function information and time information, and a display means for displaying function information and time information based on a drive signal from said display drive means, said electronic watch further comprising an energy-saving operating condition in which power consumption is less than in a normal operating condition, and being configured so that a function operating condition of said function information generation means is given higher priority than an energy-saving operating condition.

2. An electronic watch comprising a reference signal generation means, a time information generation means for generating time information based on a reference signal from said reference signal generation means, a function information generation means for generating function information, a display drive means, which outputs a drive signal for displaying function information and time information, and a display means for displaying function information and time information based on a drive signal from said display drive means, said electronic watch further comprising an energy-saving operating condition in which power consumption is less than in a normal operating condition, and being configured so that in a case in which said function information generation means goes into an operating condition during an energy-saving operating condition, said energy-saving operating condition is cancelled.

3. An electronic watch comprising a reference signal generation means, a time information generation means for generating time information based on a reference signal from said reference signal generation means, a function information generation means for generating function information, a display drive means, which outputs a drive signal for displaying function information and time information, and a display means for displaying function information and time information based on a drive signal from said display drive means, said electronic watch further comprising an energy-saving operating condition in which power consumption is less than in a normal operating condition, and being configured so that in a case in which a condition for entering said energy-saving operating condition is satisfied when said function information generation means is in an operating condition, said energy-saving operating condition is not entered.

4. An electronic watch according to any one of claim 1 to claim 3, wherein there is partial overlap between a prescribed means stopped when said energy-saving operating condition occurs and a prescribed means operating when a function operating condition occurs in said function information generation means.

5. An electronic watch according to any one of claim 1 to claim 3, wherein when all prescribed means stopped when said energy-saving operating condition occurs are cancelled from said energy-saving operating condition when a function operating condition occurs in said function information generation means.

6. An electronic watch according to any one of claim 1 to claim 3, wherein, part of prescribed means stopped when said energy-saving operating condition occurs is maintained in said energy-saving operating condition even if said function information generation means goes into a function operating condition.

7. An electronic watch comprising a reference signal generation means, a time information generation means for generating time information based on a reference signal from said reference signal generation means, a function information generation means for generating function information, a display drive means, which outputs a drive signal for displaying function information and time information, and a display means for displaying function information and time information based on a drive signal from said display drive means, said electronic watch further comprising an energy-saving operating condition detection means, which detects existence or non-existence of a condition requiring energy-saving operation, and a control means capable of performing control of each said display drive means so as to be in a normal operating condition, a energy-saving operating condition, in which power consumption is less than said normal operating condition, or a function operating condition, wherein said control means performs control so that, in response to a detection signal of said energy-saving operating condition detection means, part or all of said display means is set to said energy-saving operating condition, and in response to an output signal of a function operating condition detection means part or all of said function information display means is set to a function operating condition, and further so that in a case in which said energy-saving operating condition detection signal and a function operating condition detection signal contend, a function operating condition in at least part of said display means is given priority over an energy-saving operating condition in said display means.

8. An electronic watch according to claim 7, wherein said control means, in a case in which at least part of said time information display means is in a normal condition, in response to a detection signal from said function operating condition detection means or a detection signal from said energy-saving operating condition detection means, performs control so that either the display means is placed in the energy-saving operating condition, or the display means is placed in the function operating condition, and when a detection signal from said energy-saving operating condition detection means is detected when said display means is placed in said function operating condition, the detection signal from said energy-saving operating condition detection means is invalidated.

9. An electronic watch according to claim 7, wherein said control means, in a case in which at least part of said display means is in a normal condition, in response to a detection signal from said function operating condition detection means or a detection signal from said energy-saving operating condition detection means, performs control so that either the display means is placed in the energy-saving operating condition, or the display means is placed in the function operating condition, and when said display means is in said energy-saving operating condition, if a detection signal is output from said function operating condition detection means, the energy-saving operating condition in said display means is cancelled, and said function information display means is set to said function operating condition.

10. An electronic watch according to any one of claims 1 to 3 or 7 to 9, wherein at least part of said display means is formed by a digital display mechanism or an analog display mechanism.

11. An electronic watch according to any one of claims 1 to 3 or 7 to 9, wherein a power supply driving each means of said electronic watch is one type selected from a primary cell or an electrical generation means such as a solar cell, a manual wound electrical generator, a self-winding electrical generator, a temperature-difference electrical generator, or a combination of an electrical storage means such as a secondary cell or storage cell and an electrical generation means.

12. An electronic watch according to any one of claims 1 to 3 or 7 to 9, further comprising a pressure sensor, said electronic watch being configured so that, based on sensing information from said pressure sensor, function information of said function information generation means can be used to measure either altimeter function information or water depth gauge function information.

13. An electronic watch according to any one of claims 1 to 3 or 7 to 9, further comprising a temperature sensor, said electronic watch being configured so that, based on sensing information from said temperature sensor, function information of said function information generation means can be used to measure either temperature function information or water temperature function information.

14. An electronic watch according to claim 12, wherein a condition for canceling said energy-saving operating condition is that a water-sensing switch is detected on.

15. An electronic watch according to any one of claims 1 to 3 or 7 to 9, further comprising a delay means for the purpose, which, after a condition for entering said energy-saving operating condition is satisfied, after a prescribed delay time is counted, causes transition from said normal operating condition to said energy-saving operating condition.

16. An electronic watch according to claim 15, wherein in a case in which said function information generation means has gone into an operating condition, the counting operation of a delay time in said delay means is stopped by a reset control or the like.

17. An electronic watch according to claim 15, wherein during an operating condition of said function information generation means, a reset condition of said delay means is maintained.

18. An electronic watch according to any one of claims 1 to 3 or 7 to 9, wherein said energy-saving operating condition stops part of a circuit means among an integrated circuits driving said electronic watch is stopped.

19. An electronic watch according to any one of claims 1 to 3 or 7 to 9, wherein said energy-saving operating condition stops part of said display means.

20. An electronic watch according to claim 19, wherein said part of said display means is a second hand.

21. An electronic watch according to any one of claims 1 to 3 or 7 to 9, wherein said energy-saving operating condition detection means is formed by either a mechanism that automatically detects an electrical generation condition of said electrical generation means, an output voltage or an output current of a primary or second cell, or the amount of light illumination on said electronic watch, or a setting mechanism for manual operation.

22. An electronic watch according to any one of claims 1 to 3 or 7 to 9, wherein said electronic watch is configured so that in said energy-saving operating condition, when the operating condition of said function information generation means once being in a function operating condition ends, in a case in which a condition for entering said energy-saving operating condition is maintained from before, return is immediately made to said energy-saving operating condition.

23. An electronic watch according to any one of claims 1 to 3 or 7 to 9, wherein in a case in which said function information generation means enters a function operating condition when in said energy-saving operating condition, a time for prescribed function operation in said function information generation means is set so as to be shorter than a time for prescribed function operation in said function information generation means for a normal operation condition.

24. A method for driving an electronic watch comprising a reference signal generation means, a time information generation means for generating time information based on a reference signal from said reference signal generation means, a function information generation means for generating function information, a display drive means, which outputs a drive signal for displaying function information and time information, and a display means for displaying function information and time information based on a drive signal from said display drive means, said electronic watch further comprising an energy-saving operating condition in which power consumption is less than in a normal operating condition, whereby a function operating condition of said function information generation means is given higher priority than an energy-saving operating condition.

25. A method for driving an electronic watch comprising a reference signal generation means, a time information generation means for generating time information based on a reference signal from said reference signal generation means, a function information generation means for generating function information, a display drive means, which outputs a drive signal for displaying function information and time information, and a display means for displaying function information and time information based on a drive signal from said display drive means, said electronic watch further comprising an energy-saving operating condition in which power consumption is less than in a normal operating condition, whereby in a case in which said function information generation means goes into an operating condition during an energy-saving operating condition, said energy-saving operating condition is cancelled.

26. A method for driving an electronic watch comprising a reference signal generation means, a time information generation means for generating time information based on a reference signal from said reference signal generation means, a function information generation means for generating function information, a display drive means, which outputs a drive signal for displaying function information and time information, and a display means for displaying function information and time information based on a drive signal from said display drive means, said electronic watch further comprising an energy-saving operating condition in which power consumption is less than in a normal operating condition, whereby in a case in which a condition for entering said energy-saving operating condition is satisfied when said function information generation means is in an operating condition, said energy-saving operating condition is not entered.

27. A method for driving an electronic watch according to any one of claim 24 to claim 26, wherein in a case in which an operating condition of said function information generation means ends, said display drive means drives the display means in either a normal operating condition or an energy-saving operating condition.

28. A method for driving an electronic watch according to any one of claim 24 to claim 26, wherein said electronic watch is further provided with an electrical generation means and an electrical storage means charged from said electrical generation means, whereby when in the case in which either the output voltage or the output current of the electrical generation means is judged to be insufficient to place the time information generation means in the operating condition, the display of said display means is stopped.

29. A method for driving an electronic watch comprising a reference signal generation means, a time information generation means for generating time information based on a reference signal from said reference signal generation means, a function information generation means for generating function information, a display drive means, which outputs a drive signal for displaying function information and time information, and a display means for displaying function information and time information based on a drive signal from said display drive means, said electronic watch further comprising a function non-operating condition detection means for detecting a non-operating condition of said function information generation means, a function operating condition detection means for detecting an operating condition, and a control means capable of performing control whereby each individual display drive means is placed in one of a normal operating condition, an energy-saving operating condition having a smaller power consumption that said normal operating condition, and a function operating condition, whereby in response to a detection signal of said non-operating condition detection means, part or all of said display means is set to an energy-saving operating condition, and in response to a detection signal of said function operating condition detection means, part or all of said function information display means is set to a function operating condition.

30. A method for driving an electronic watch according to any one of claims 24 to 26 or 29, wherein when an operating condition of a function information generation means having one in a function operating condition ends while under the energy-saving operating condition, in a case in which a condition for entering said energy-saving operating condition is maintained as before, return is made immediately to said energy-saving operating condition.

31. A method for driving an electronic watch according to any one of claims 24 to 26 or 29, wherein in a case in which said function information generation means enters the function operating condition while in said energy-saving operating condition, the amount of time of a prescribed function operation of said function information generation means is set so as to be shorter than an amount of said prescribed function operation under a normal condition of said function information generation means.

32. An electronic watch comprising a reference signal generation means, a time information generation means for generating time information based on a reference signal from said reference signal generation means, a function, information generation means for generating function information, a display drive means, which outputs a drive signal for displaying function information and time information, and a display means for displaying function information and time information based on a drive signal from said display drive means, said electronic watch further comprising a function non-operating condition detection means for detecting a non-operating condition of said function information generation means, a function operating condition detection means for detecting an operating condition, and a control means capable of performing control whereby each individual display drive means is placed in one of a normal operating condition, an energy-saving operating condition having a smaller power consumption than that of said normal operating condition, and a function operating condition, whereby in response to a detection signal of said non-operating condition detection means, part or all of said display means is set to an energy-saving operating condition by said control means, and in response to a detection signal of said function operating condition detection means, part or all of said function information display means is set to a function operating condition by said control means.

* * * * *